US007676877B2

(12) United States Patent
Policicchio et al.

(10) Patent No.: US 7,676,877 B2
(45) Date of Patent: Mar. 16, 2010

(54) CLEANING IMPLEMENTS AND SUBSTRATES FOR CLEANING SURFACES

(75) Inventors: Nicola John Policicchio, Mason, OH (US); Leonard Lik-Hang Tse, West Chester, OH (US); William Michael Cannon, West Harrison, OH (US); Kenton Ray Lynde, Mason, OH (US); Michael Stephen Maile, Maineville, OH (US); Robert Allen Godfroid, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1347 days.

(21) Appl. No.: 11/055,891

(22) Filed: Feb. 11, 2005

(65) Prior Publication Data

US 2005/0181968 A1 Aug. 18, 2005

Related U.S. Application Data

(60) Provisional application No. 60/544,048, filed on Feb. 12, 2004, provisional application No. 60/546,932, filed on Feb. 23, 2004, provisional application No. 60/632,081, filed on Dec. 1, 2004.

(51) Int. Cl.
*A47L 11/24* (2006.01)
*A47L 11/33* (2006.01)

(52) U.S. Cl. ..... 15/41.1

(58) Field of Classification Search ..... 15/41.1
See application file for complete search history.

(56) References Cited

U.S. PATENT DOCUMENTS

| | | | | |
|---|---|---|---|---|
| 583,738 | A | 6/1897 | Fawell | |
| 601,868 | A | 4/1898 | Brooks | |
| 1,267,304 | A | 5/1918 | Adams | |
| 2,515,671 | A * | 7/1950 | Snyder et al. | 280/43.17 |
| 2,689,367 | A | 9/1954 | Parker | |
| 3,651,529 | A | 3/1972 | Popeil et al. | |
| 3,909,869 | A * | 10/1975 | Hukuba et al. | 15/49.1 |
| 4,502,173 | A * | 3/1985 | Pätzold et al. | 15/41.1 |
| 4,646,380 | A * | 3/1987 | Kobayashi et al. | 15/41.1 |
| 4,701,969 | A * | 10/1987 | Berfield et al. | 15/79.1 |
| 5,208,935 | A * | 5/1993 | Jailor et al. | 15/41.1 |
| 5,525,397 | A * | 6/1996 | Shizuno et al. | 428/138 |
| 2004/0168281 | A1 | 9/2004 | Sako et al. | |

FOREIGN PATENT DOCUMENTS

| | | |
|---|---|---|
| DE | 44 00 956 C1 | 10/1994 |
| GB | 2 135 869 A | 9/1984 |
| GB | 2 389 035 A | 12/2003 |

OTHER PUBLICATIONS

PCT International Search Report, 7 pages, Mailed Oct. 7, 2005.

* cited by examiner

*Primary Examiner*—Randall Chin
(74) *Attorney, Agent, or Firm*—Larry L. Huston

(57) ABSTRACT

A cleaning implement for cleaning a soft or a hard surface comprises a handle, a sweeper head, rotating blades and a collection bin. The bottom wall of the collection bin includes an opening that is covered by a cleaning sheet during the cleaning operation. The height of this bottom wall relative to the surface being cleaned is adjustable by a user. The cleaning implement can be used with a disposable cleaning sheet, which includes protrusions that are capable of removing entangled hair from a carpet surface.

10 Claims, 23 Drawing Sheets

CLEANING IMPLEMENTS AND SUBSTRATES FOR CLEANING SURFACES

CROSS REFERENCE TO RELATED APPLICATION

This application claims the benefit of U.S. Provisional Application No. 60/544,048, filed Feb. 12, 2004; U.S. Provisional Application No. 60/546,932, filed Feb. 23, 2004; and U.S. Provisional Application No. 60/632,081, filed Dec. 1, 2004."

TECHNICAL FIELD

The present invention relates to cleaning implements which can be used with a disposable cleaning substrate removably attached to the implement for removing debris, such as particulates, food crumbs, human hair, pet hair, dirt, dust, and the like, from surfaces, such as carpets, straw mats (e.g., tatami), hard floors, fabrics, upholstery, and the like.

BACKGROUND OF THE INVENTION

Removing soils and debris from soft surfaces such as upholstery or carpet in a quick, easy and convenient manner can be particularly difficult. Part of the difficulty comes from the broad range of soils, which are found on soft surfaces. Unlike hard floor surfaces such as vinyl floors, hard wood floors or ceramic tiles, which are mainly covered with "loose" soils, soft surfaces contain both "loose soils" and "soils capable of entanglement". By "loose soils" it is meant any soil, which sits freely on top of the surface to be cleaned and which can be displaced easily. Typical loose soils include food crumbs, sugar grains, cereals, paper, gravel, sand, grass and the like. By "soils capable of entanglement" it is meant any soil, which is trapped around carpet fibers and which cannot be displaced easily. Soft surfaces, such as carpets, have fibers causing loose soils to get snagged in the fibers. Typical soils capable of entanglement include human hair, pet hair, threads and the like. While removing "loose soils" and "soils capable of entanglement" from soft surfaces is particularly challenging, it is beneficial that the system also be capable of also removing these same soils from other surfaces such as hard floors since many homes contain both soft and hard surfaces.

The literature is replete with devices, such as vacuum cleaners or carpet sweepers, which can be used to remove debris and clean soft and hard surfaces.

Vacuum cleaners can be very effective for picking up loose soils but are moderately effective for removing soils capable of entanglement particularly human or pet hair. In addition, vacuum cleaners are relatively heavy and cumbersome, and consequently, are not convenient for everyday use including use on hard floor surfaces. "Lighter" vacuum cleaners (having a weight of less than about 3 kg), which are battery operated, have been developed. Although these are more user-friendly in the sense that they are more maneuverable and easier to use especially on hard floor surfaces, they are not very effective at removing soils capable of entanglement.

Light weight sweepers have also been developed, which typically include a rotating brush, which is located in the front of the sweeper and which can be either electrically or mechanically driven. The rotating brush includes bristles, which project loose soils into a collection bin. Once the user has finished cleaning a carpet, he or she can empty the bin into a trash container. In addition, the rotating brush can remove soils capable of entanglement from a surface, even if soils are in an entangled state with fibers of soft surface. However, it has been observed that soils capable of entanglement, in particular hair, tend to wrap around the rotating brush. Over time, the rotating brush becomes saturated with these soils capable of entanglement. As a result, these soils reduce the ability of the rotating brush and its bristles to project loose soils into the collection bin. Eventually, a user needs to remove frequently and by hand the loose soils entangled in the bristles of the brush. The process of removing wrapped hair from a brush is both inconvenient and unhygienic. In order to prevent hair from getting entangled on the rotating brush, some carpet sweepers include continuous rotating blades as opposed to individual bristles. These continuous blades are relatively effective at projecting loose soils into a collection bin but they are also relatively ineffective at removing soils capable of entanglement, in particular long cylindrical soils such as hair or threads particularly if they are in an entangled state with the fibers of soft surface.

In summary a light weight sweeper which can effectively remove both "Loose" and "Soils capable of entanglement" from surfaces while being easy to use and not have negatives in hygiene (e.g., having to remove long cylindrical soils wrapped around a roller) is something that is highly desirable by consumers. It is found that a way to achieve all these benefits without negatives is to use a soil separation approach. By soil separation it is meant that design the sweeper system such that different areas of the sweeper are optimized to handle the different soils found on soft and/or textured surfaces like carpets, straw mats (e.g., tatami), fabrics, upholstery and on hard surfaces like wood floors, vinyl, ceramic and the like where both "Loose" and "Soils capable of entanglement" entangled can be found.

It is therefore one object of this invention to provide a cleaning implement and a disposable cleaning substrate for removing both loose soils and soils capable of entanglement from a soft and/or hard surfaces in a convenient and hygienic manner.

It is also one object of this invention to provide an effective, convenient, easy to use and more hygienic method of removing both loose soils and soils capable of entanglement from soft and/or hard surfaces.

SUMMARY OF THE INVENTION

In one embodiment, the invention is directed to a cleaning implement for cleaning a soft and/or a hard surface, that comprises a sweeper head having a collection bin with a first opening and a rotating member for projecting loose soils from the surface being cleaned into the collection bin through the first opening and a disposable cleaning substrate having a top and a bottom surface and a plurality of protrusions extending from the bottom surface.

In another embodiment, the invention is directed to a cleaning implement for cleaning a soft and/or a hard surface, which comprises a sweeper head having a collection bin including a front wall and a bottom wall wherein the front wall comprises at least one opening and the bottom wall comprises at least one opening, the sweeper head having a rotating member for projecting loose soils from the surface being cleaned into the collection bin through the opening of said front wall and a disposable cleaning substrate having a top and a bottom surface wherein the disposable cleaning substrate is removably attachable to the sweeper head such that the disposable cleaning substrate covers at least partially the opening of the bottom wall.

In another embodiment, the invention is directed to a cleaning implement for cleaning a soft and/or a hard surface, which comprises a sweeper head having a collection bin having a first opening, a rotating member for projecting loose soils from the surface being cleaned into the collection bin through the first opening wherein the rotating member comprises a rotating shaft and at least one blade member connected to the rotating shaft, wherein the at least one blade member comprises at least one weakness extending through the blade member and a disposable cleaning substrate removably attachable to the sweeper head.

In another embodiment, the invention is directed to a cleaning implement for cleaning a soft and/or a hard surface, which comprises a sweeper head having a collection bin having a first opening wherein the collection bin is removably connected to the sweeper head, the sweeper head comprising a rotating member for projecting loose soils from the surface being cleaned into the collection bin through the first opening and a disposable cleaning substrate removably attachable to the collection bin.

In another embodiment, the invention is directed to a cleaning implement for cleaning a soft and/or a hard surface, which comprises a sweeper head having a collection bin including a first opening and a rotating member for projecting loose soils from the surface being cleaned into the collection bin through the first opening, wherein the height of at least a portion of the collection bin is adjustable relative to the surface to be cleaned.

In another embodiment, the invention is directed to a disposable cleaning substrate for cleaning a surface which comprises a first substrate layer having a top and a bottom surface, a plurality of protrusions extending from the bottom surface of the first substrate layer and an additive selected from the group consisting of tacky polymers, pressure sensitive adhesives, oil gels, waxes, and any mixtures thereof, where the additive is applied on at least a portion of the top surface of the first substrate layer.

In another embodiment, the invention is directed to a method of cleaning a surface, the method comprising the steps of providing a disposable cleaning substrate having a top and a bottom surface, attaching the disposable cleaning substrate to the sweeper head, wherein the sweeper head comprises a rotating member for projecting loose soils from the surface to be cleaned into a collection bin through a first opening of the collection bin, and a second opening on a bottom wall of the collection bin, such that the disposable cleaning substrate covers at least partially the second opening and moving the sweeper head across the surface to be cleaned such that at least a portion of the bottom surface of the cleaning substrate contacts the surface to be cleaned and such that some loose soils are projected by the rotating member onto a portion of the top surface of the cleaning substrate.

In another embodiment, the invention is directed to a disposable cleaning substrate for cleaning a soft surface, which comprises a first substrate layer having a top and a bottom surface, a plurality of protrusions extending from the bottom surface of the substrate layer and a second substrate layer, wherein the second substrate layer is connected to the top surface of the first substrate layer such that the first and second substrate layers form a pocket.

In another embodiment, the invention is directed to a cleaning implement for cleaning a soft and/or a hard surface, which comprises a sweeper head having a top and a bottom surface, the sweeper head including a collection bin having a first opening and a rotating member for projecting soils from the surface being cleaned into the collection bin through the first opening, wherein the bottom surface of the sweeper head comprises at least one stationary gliding member wherein at least a portion of said stationary gliding member is capable of contacting the surface being cleaned and wherein the portion of the stationary gliding member that contacts the surface being cleaned is made of a low friction material.

In another embodiment, the invention is directed to a cleaning implement for cleaning a soft and/or a hard surface, which comprises a sweeper head having a collection bin including a front opening, at least one side wall and a bottom wall operably and movably connected to the side wall wherein the bottom wall is operably movable from a first position to a second position.

In another embodiment, the invention is directed to a disposable cleaning sheet having a front portion and a back portion and which comprises a lower layer of material having a top and a bottom surface, the bottom surface comprising an additive for retaining soils, an upper layer of material, wherein the upper layer is connected to the lower layer such that the lower and upper layers define an internal volume that is at least partially enclosed wherein the at least partially enclosed volume is accessible via at least one opening and an extension piece connected to the front portion of said cleaning sheet.

In another embodiment, the invention is directed to a disposable cleaning sheet which comprises at least one layer of a nonwoven material having a top and a bottom surface and a leading edge wherein said top surface comprises a tacky additive and wherein said bottom surface comprises a tacky additive, a first layer of a liner material covering at least a portion of said tacky additive of said top surface, a second layer of a liner covering at least a portion of said tacky additive of said bottom surface and an extension piece substantially adjacent to said leading edge of said cleaning sheet.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE INVENTION

Figure 1:
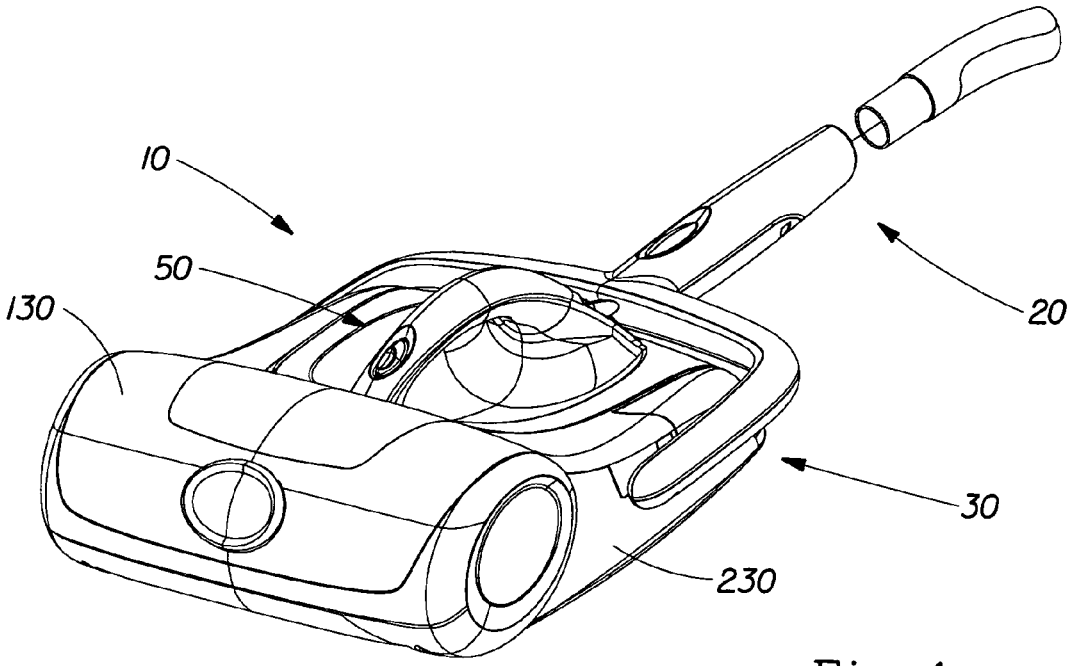
FIG. 1 is a perspective view of a cleaning implement of the present invention.

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

While not intending to limit the utility of the cleaning implement herein, it is believed that a brief description of its use in association with a disposable substrate will help elucidate the invention.

Numerous devices are known to clean carpets. The most common are vacuum cleaners and carpet sweepers. Vacuum cleaners remove particulates by generating a negative pressure or suction flow on an area that is adjacent the carpet, generally on top of the carpet. Their ability to remove these particulates depends at least in part on the power of the electric motor used to generate this negative pressure. As a result, the most powerful vacuum cleaners require to be plugged to an electrical outlet during the whole cleaning operation. Although vacuum cleaners are particularly effective at removing loose particles, they are not as effective at removing soils capable of entanglement from carpets. Some vacuum cleaners include a stationary or rotative brush having a plurality of bristles for disentangling this type of soil. Although a brush can be effective at removing soils capable of entanglement from a carpet, these soils are then found into the bristles of the brush. To some extent, the "entangled" soils are transferred from the carpet to the bristles of the brush. As the brush gets saturated with the "entangled" soils, a user must remove these by hand. Typical carpet sweepers remove soils via of a rotative brush or blade, which projects particulates into a collection bin. The ability of the sweepers to remove particulates depends in part on the rotational speed of the brush or the blade. As a result, electrically powered versions of the sweepers are often more effective at cleaning carpets. The rotative brush of a sweeper has the same disadvantage as the brush of a vacuum cleaner, i.e. soils capable of entanglement tend to get re-entangled in the bristles of the brush. This problem is at least partially solved by replacing the rotative brush and its bristles, with a continuous rotative blade. Since it does not offer any anchor point for the fibrous soil. While it can be beneficial to prevent "entangled" soils from getting simply transferred to the rotative member (i.e. brush) of the carpet sweeper, it results that these "entangled" soils are then left on the carpet.

The cleaning implement and disposable cleaning substrate of the present invention offer to a user the ability to easily, effectively and hygienically remove both "loose" soils and "soils capable of entanglement" from surfaces. The cleaning implement includes a rotating member capable removing loose soils from a surface and capable of projecting these soils into a collection bin. The disposable cleaning substrate can include protrusions for loosening and/or removing soils capable of entanglement from the soft surface and optionally an additive to aide trapping these soils on the substrate once removed. The cleaning substrate can be removably attached to the bottom surface of the cleaning implement such that at least a portion of the cleaning substrate comes in contact with the surface to be cleaned during the cleaning operation. When the cleaning implement is moved across the soft surface, the protrusions of the cleaning substrate loosen and/or remove soils capable of entanglement while the rotating member of the cleaning implement projects loose soils from the soft or hard surface into a collection bin. Once the floor surface is cleaned, a user can remove the disposable cleaning substrate from the implement and put it in a trash can along with the content of the collection bin.

The foregoing considerations are addressed by the present invention, as will be clear from the detailed disclosures which follow.

As discussed more fully hereafter, the present invention is, in its most preferred form, directed to a cleaning implement generally comprising a handle connected to a sweeper head. The cleaning implement is well suited to hold a removably attachable and disposable cleaning substrate.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

I. Cleaning Implement

1) Sweeper Head.

Figure 2:
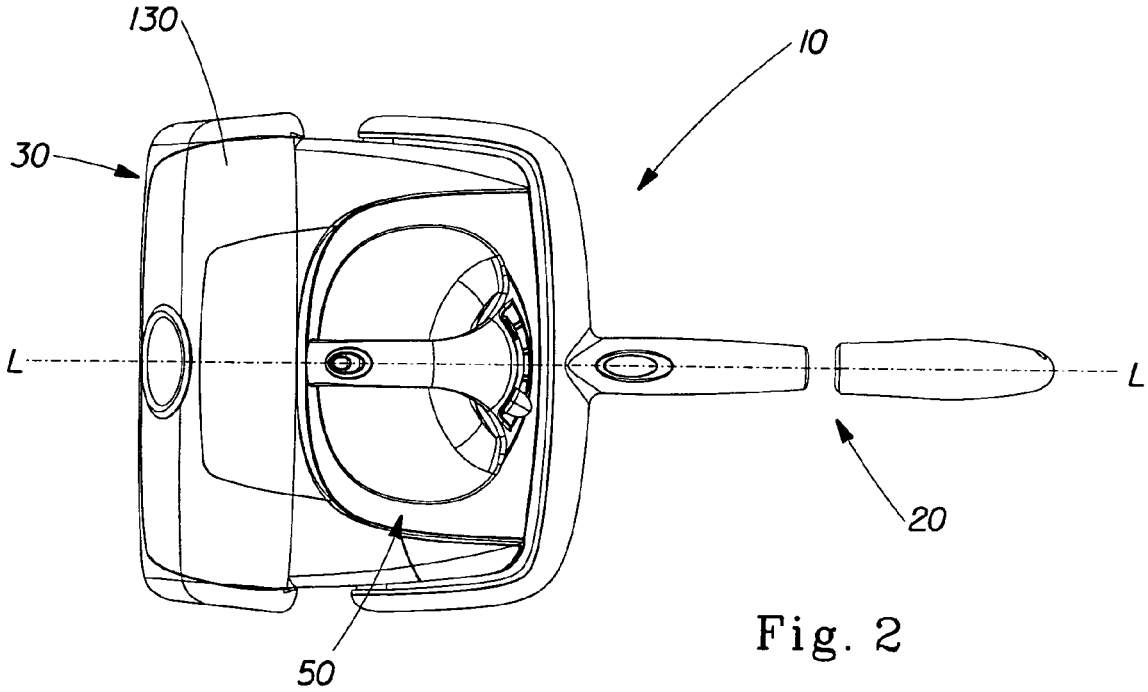
FIG. 2 is a top view of the cleaning implement of FIG. 1.
Figure 3:
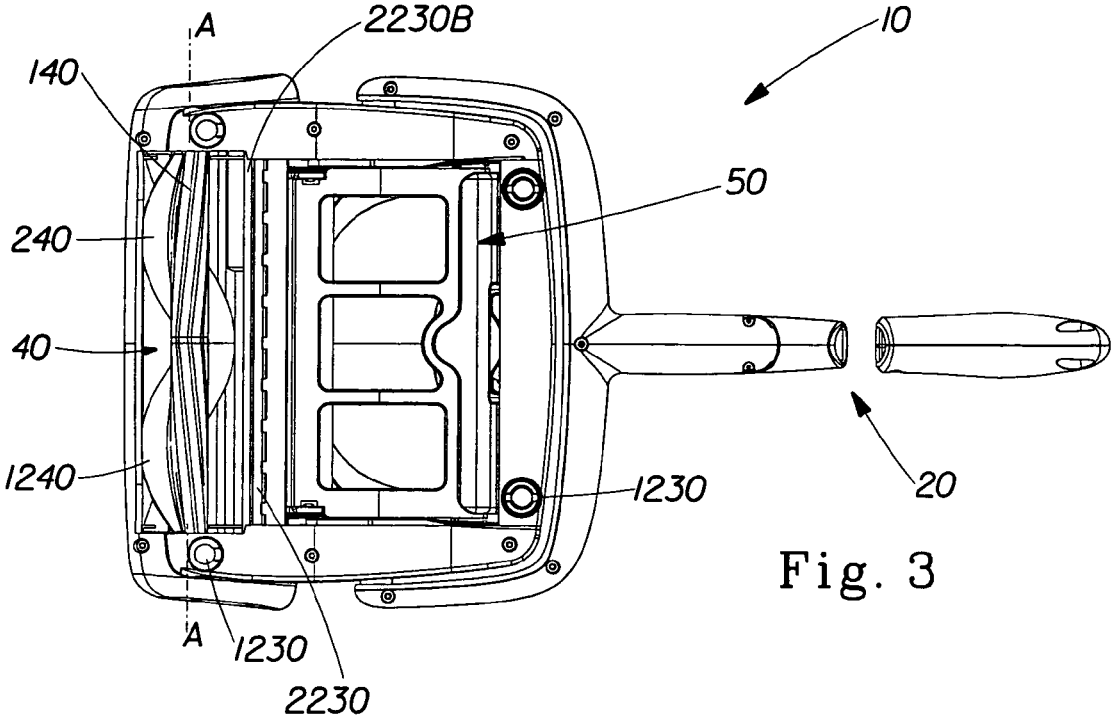
FIG. 3 is a bottom view of the cleaning implement of FIG. 1.

FIGS. 1, 2 and 3 show respectively a perspective, a top view and a bottom view of a cleaning implement 10 made in accordance with one embodiment of the present invention.

In one embodiment, the cleaning implement 10 includes a handle 20 (only shown partially for clarity) connected to a sweeper head 30. In one embodiment, the sweeper head 30 includes an upper body portion 130 attached to a lower body portion 230. The upper and lower body portions 130, 230 house and protect the internal components of the sweeper head 30.

In one embodiment, the sweeper head includes a rotating member 40 for removing loose soils from a surface to be cleaned and transferring these soils into a collection bin 50. The rotating member 40 can be located either in front or behind the collection bin 50 and still provide the same benefits. In a preferred embodiment, the rotating member 40 is located in front of the collection bin as shown in FIG. 3. The rotating member 40 comprises a shaft 140 which is capable of rotating about a rotational axis A-A and at least one, but preferably a plurality of blade members 240, connected to the shaft 140 and extending outwardly from the shaft 140. The rotational axis A-A is preferably substantially parallel to the surface being cleaned in order to maximize the ability of the rotating member to remove loose soils during the cleaning operation.

Figure 4:
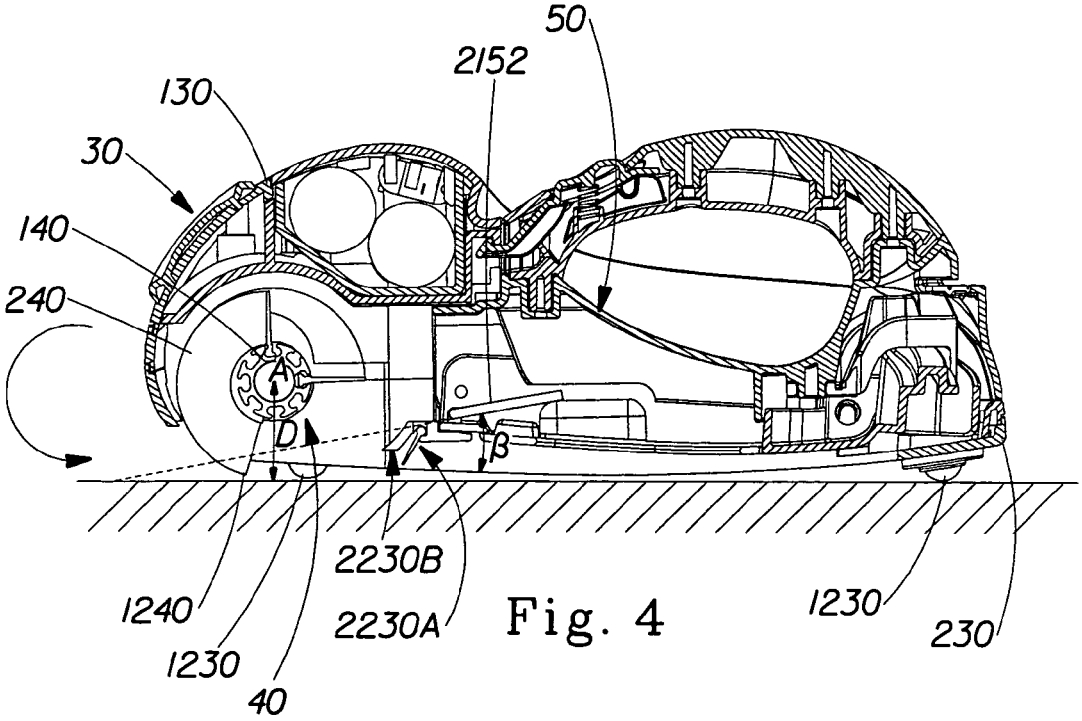
FIG. 4 is a cross sectional side view of t the cleaning implement of FIG. 2, taken along line 4-4 thereof.

FIG. 4 shows a cross section of the cleaning implement 10 along the 4-4 axis (shown in FIG. 2). When the shaft member 140 and the blade members 240 rotate, the blade members can flick or project loose soils from the soft surface, into the collection bin 50. One skilled in the art will understand that depending on the location of the rotating member 40 relative to the collection bin 50, the rotational direction of the shaft 140 is chosen such that loose soils are flicked or projected substantially towards the collection bin 50. In the embodiment shown in FIG. 4, where the rotating member is located in front of the collection bin, it is preferred that the shaft 140 rotates counterclockwise. Conversely, if the rotating member 40 is located behind the collection bin 50, it is preferred that the shaft 140 rotates clockwise.

In one embodiment shown in FIG. 3, the lower body portion 230 of the sweeper head 30 includes a first longitudinal element and a second longitudinal element. The first and a second longitudinal elements preferably form respectively the right and left side of the lower body portion 230. In a preferred embodiment, the first and a second longitudinal elements are spaced apart such that they do not interfere with the rotating member 40 and/or the collection bin 50. Among other benefits, the first and a second longitudinal elements prevent the sweeper head 30 from "sinking" into a compressible soft surface due to the weight of the sweeper head but also when pressure is applied by a user in a forward and backward motion of the cleaning implement. In addition, the first and a second longitudinal elements allow the sweeper head 30 to glide across a soft surface.

In one embodiment, the length of a longitudinal element is between about 10 mm and about 400 mm, preferably between about 50 mm and about 200 mm and the width of a longitudinal element is between about 3 mm and about 150 mm, preferably between about 10 mm and about 75 mm.

In one embodiment, the first and a second longitudinal elements are made of a low friction material. By "low friction material" it is meant any material having a static coefficient of friction of less than about 0.7. The static coefficient of friction can be measured via ASTM method D3702. In one embodiment, the longitudinal element can have a static coefficient of friction of less than about 0.6, preferably less than about 0.5, more preferably less than about 0.4 and even more preferably less than about 0.25. Non-limiting examples of suitable low friction materials include TEFLON®, polypropylene, polyester, polyethylene, NYLON®, acetal resin, acrylonitrile butadiene styrene, polyethylene terephthalate, ARMOSLIP® and any mixtures thereof. Additionally, slip agents or low friction material can be added in the form of a coating, a plate or a film, to higher friction materials such as rubber, foam, vinyl and the like in order to lower the frictional resistance of the longitudinal element(s). It is observed that longitudinal elements including a low friction material allow the sweeper head to be moved in any direction across a surface being cleaned, especially a carpet surface. The longitudinal elements allow the sweeper to translate from side to side across a soft surface with minimum effort from the user and still allow the rotating member to remove loose soils from the soft surface effectively. The multidirectional movement of a sweeper head improves the maneuverability and convenience of use of the cleaning implement.

In one embodiment, the first and a second longitudinal elements are substantially flat.

In another embodiment, the first and a second longitudinal elements are curved. In a preferred embodiment, the first and a second longitudinal elements are curved outwardly relative to the sweeper head 30. The outwardly curved longitudinal elements allow the sweeper head 30 "to rock" and/or pivot forward and backward during the cleaning operation. In one embodiment, the radius of curvature of the longitudinal elements is constant. In another embodiment, the radius of curvature of the longitudinal elements varies from the front portion to the rear portion of the longitudinal elements. In a preferred embodiment, the radius of curvature of the front portion of the longitudinal elements is greater than the radius of curvature of the rear portion of the longitudinal elements. The radius of curvature of a curved longitudinal element can be determined by measuring the radius of a circle including at least an arc portion of the longitudinal element. In one embodiment, the radius of curvature of a longitudinal element is at least about 100 mm, preferably at least about 500 mm, more preferably at least about 1000 mm. In one embodiment, the radius of curvature is between about 100 mm and about 2500 mm. One skilled in the art will understand that the radius of curvature of the longitudinal elements, the location of the resulting "rocking axis" of the sweeper head and the weight distribution of the sweeper head can impact the amplitude or magnitude of the rocking motion. In a preferred embodiment, the rocking axis of the sweeper head is located between the rotating member 40 and the rear portion of the collection bin 50. One skilled in the art will understand that when the sweeper head is pushed forward by a user, the sweeper head "rocks" or "tilts" backward causing the rear portion of the sweeper head to move closer to the surface being cleaned while the front portion moves away from the surface being cleaned). Conversely, when the sweeper head is pulled backward, the sweeper head "rocks" or "tilts" forward causing the rear of the sweeper head (and the collection bin) to move away from the surface being cleaned while the front of the sweeper head (and the rotating member) moves closer to the surface being cleaned. It is observed that during a typical cleaning operation, a user tends to apply more pressure in a forward motion in comparison to the backward motion. As such, when the cleaning implement is used with a disposable cleaning substrate, which is attached to the rear bottom surface of the sweeper head (in particular a cleaning substrate with protrusion as described infra), and when a user pushes the sweeper head forward, the rocking motion increases the contact between the cleaning substrate and the surface being cleaned. As a result, the rocking motion improves the cleaning performance of the sheet cleaning substrate. Because the cleaning substrate contacting the floor surface is the main source of frictional resistance, it is also beneficial for the sweeper head "to rock or tilt" backward when the user unconsciously tends to apply the most pressure to the sweeper head. Conversely, when a user pulls the sweeper head backward, the rocking motion decreases the contact surface between the cleaning substrate and the surface to be cleaned. Since a decrease of the contact surface between the cleaning surface and the surface being cleaned results in less frictional resistance, it is beneficial for the sweeper head to rock or tilt forward when a user tends to apply less pressure in the pulling action/backward motion. It is also observed that during the pulling action/backward motion (i.e. when the cleaning substrate is moved away from the surface being cleaned), the loose soils, which had not been permanently "captured" by the cleaning substrate or which had not been captured by the rotating member in a previous pushing action/forward motion, can now pass underneath the collection bin. Because the rotating member moves closer to the surface being cleaned in a pulling action/backward motion, the rotating member has a greater chance of projecting these loose soils into the collection bin.

In one embodiment shown in FIGS. 3 and 4, the lower body portion 230 of the sweeper head 30 includes at least one but preferably a plurality of gliding member 1230 located at the bottom of the lower body portion. In one embodiment, the lower body portion 230 comprises four gliding members 1230 which are preferably located in the proximity of each corner of the sweeper head. During the cleaning operation of a floor surface (either hard or soft surface), the gliding members are in contact with the surface being cleaned, allowing the sweeper head "to glide" across this surface.

In one embodiment, the gliding members 1230 are made of a low friction material previously discussed. The gliding members 1230 can be formed independently from the lower body portion 230 and then be attached thereto or they can be formed and/or molded directly within the lower body portion 230 and still provide the same benefits. In a preferred embodiment, the gliding members 1230 are stationary gliding members and are fixedly attached and/or connected to the lower body portion 230. In one embodiment, the movement of the sweeper head across a floor surface can be provided via a combination of stationary gliding members and wheels. In one embodiment, the sweeper head includes less than three wheels, preferably less than two wheels. In one embodiment, the sweeper head does not include any wheels and its displacement across a floor surface is provided by stationary gliding members.

In one embodiment, the gliding members 1230 are shaped such that the surface of the gliding member in contact with the surface being cleaned does not include sharp edges. In one embodiment the gliding members 1230 can have a dome and/or substantially round shape. Among other benefits, gliding members allows the sweeper head to be moved across the surface being cleaned not only in a forward and backward direction but also sideways or in a swirling motion. As a result, the gliding members 1230 improve the maneuverability of the cleaning implement, especially when the implement is used to clean dense soft surfaces such as berber carpets or hard surfaces such as hard wood floors by allowing multidirectional movement of the sweeper head. Without intending to be bound by any theory, it is believed that depending on the properties/quality of the carpet in terms of thickness, density and/or compressibility, the sweeper head can "sink" slightly into the carpet fibers. Consequently, it is believed that the gliding members with smooth and/or round edges and/or tips, not only reduce the risk of snagging and damaging the carpet but it is also believed that the gliding members enable the sweeper head to be moved in any direction across the surface being cleaned. In addition, when the cleaning implement is used to clean a hard floor surface, the gliding members maintain the sweeper head above the hard surface, and as a result, the gliding members minimize the contact surface between the lower body portion and the hard floor surface. In one embodiment, the gliding members are sized such that when the gliding members are all in contact with a hard surface, the minimum distance between the bottom surface of the longitudinal elements and the hard surface is at least about 0.5 mm, preferably at least about 1 mm, more preferably at least about 2 mm, even more preferably at least about 3 mm. By "minimum distance", it is meant the distance between the lowest point of the longitudinal element and the hard surface.

Moreover, because hard floors are more prone to scratching, conventional sweepers and vaccums use standard unidirectional wheels (i.e. wheels rotating about a single rotational axis) which limit the motion to forward and backward. The gliding members, in particular gliding members with smooth edges, can reduce the risk of scratching the hard floor surface, especially hard wood floors. In one embodiment surface safe multi-directional movement can be achieved by using casters, multidirectional rolling balls (similar to typical computer mouse ball mechanisms), and the like.

In one embodiment, the sweeper head can have a blade member 2230A operably connected to the bottom surface of the lower body portion 230 or the lower surface of the collection bin 50. In a preferred embodiment, the blade member 2230A is located between the rotative member 40 and the collection bin 50. During a typical cleaning operation, the sweeper head is moved forward and backward across the surface being cleaned. In the forward motion, the blade member 2230A creates a barrier preventing loose soils, which are projected by the rotative member 40, from reaching underneath the collection bin 50. Behind the rotative member 40 there is a sweeper ramp 2230B which aides in projecting and deflecting particles into collection bin 50. However, if the end of the sweeper ramp is too close to the cleaning surface it can dig in and make sweeper difficult to move. In a preferred embodiment the blade member 2230A can be positioned as an extension of sweeper ramp 2230B. In essence creating a flexible sweeper ramp. It has been observed that when the cleaning implement is used to clean a soft surface, such as a carpet, loose soils are projected substantially upwards and can easily reach the interior of the collection bin. However, it has also been observed that when the cleaning implement is used to clean a hard surface, such as hard wood floor, some of the loose soils have a substantially horizontal trajectory and, as a result, can be kicked underneath the sweeper head. The inclusion of a blade member 2230A which not only creates a barrier but also forms a ramp for the loose soils, increases the amount of loose soils captured in the collection bin, all without substantially creating any drag or digging of sweeper particularly when used on soft surfaces.

In a preferred embodiment, the blade member 2230 is pivotably and/or flexibly connected to the bottom surface of the lower body portion 230 such that it is capable of flapping back and forth when the sweeper head is moved forward and backward. Among other benefits, it is observed a blade member 2230, which is pivotably and/or flexibly connected to the bottom surface of the lower body portion 230, allows the loose soils located underneath the collection bin, to reach the rotative member 40. Consequently, the loose soils can then be projected by the rotative member 40 into the collection bin 50.

Figure 5:
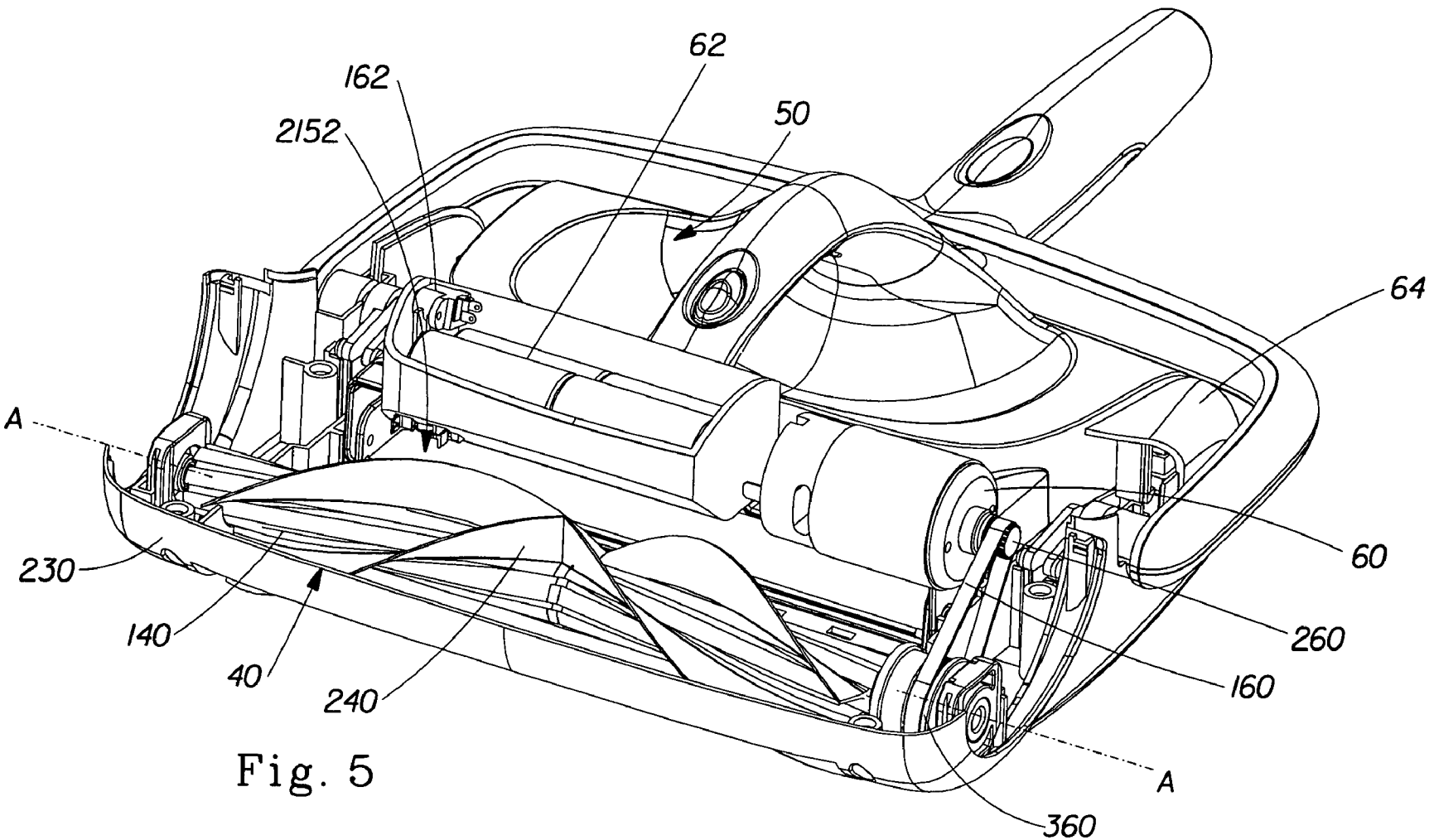
FIG. 5 is a perspective view of the cleaning implement of FIG. 1 without the upper body portion.

In one embodiment represented in FIG. 5 where the upper body portion 130 is not shown for clarity, the shaft 140 is operably connected to an electric motor 60. The electric motor 60 can be either directly or indirectly coupled to the shaft 140. By "directly coupled", it is meant that no gear elements are required between the motor and the shaft. By "indirectly coupled", it is meant that the rotational motion provided by the motor is communicated to the shaft via at least one but preferably two gears. In a preferred embodiment, the electric motor 60 is indirectly coupled to the shaft 140 via an endless belt 160, a first gear 260 and a second gear 360. The endless belt 160 is operably connected to the first gear 160 of the motor 60 and to the second gear 360 which is itself connected to the shaft 140. In one embodiment, the gear ratio between the first and second gears 260, 360 is between about 1:1 and about 20:1, preferably between about 2:1 and about 5:1. In one embodiment, the rotating member 40 is capable of rotating at a rotational speed (measured in rotations per minute, hereinafter rpm) of between about 250 rpm and about 3000 rpm, preferably between about 300 rpm and about 2400 rpm, more preferably between about 350 rpm and about 1800 rpm and even more preferably between about 400 rpm and about 1500 rpm. The inventors have found that most conventional sweepers typically use brushes and operate at over about 2500 rpm. This high rotational speed is required to not only achieve sufficient flicking of loose soils but to aide in removing soils capable of entanglement particularly when in an entangled state. Since the sweeper system defined by this invention uses a soil separation approach where different zones of the sweeper remove the different soil types (eg hooks on disposable sheet remove soils capable of entanglement), the inventors found that the sweeper can achieve effective performance at a lower rotational speed. The inventors found operating sweeper at lower rpm's can actually be beneficial in removing broader range of soils on broader range of surfaces. On hard surfaces specifically, lighter soils (such as food crumbs, dust and the like) can easily get scattered if the rotating member is spinning at rpm's which exceed 2000 rpm and gets progressively worse with each 500 rpm increase in rpm's. A simple and effective way to measure rotational member rpm's is by using a laser digital tachometer with reflective tape placed on rotating member. The measurement can be done with the rotational member being flipped upside down such that the bottom of the sweeper head faces upwards and without altering the sweeper head) in order to get consistent measurement. The rotational speed is measured using a sweeper that is supplied with constant power. The electric motor 60 can be any motor known in the art. One example of a suitable motor is manufactured by the Johnson Motor from Hong Kong (P.R. China) company and produces a stall torque of between about 1700 and about 1850 g.cm. The electric motor 60 can be powered by any source of electricity. In one embodiment, the motor can be powered by a cord connected to a wall electrical outlet. In a preferred embodiment, the motor can be powered by at least one, but preferably a plurality of batteries 62 which can be disposable and/or rechargeable. Non-limiting examples of suitable batteries include Ni—Cd rechargeable batteries manufactured by GPI Battery Co. from Hong Kong (P.R. China). The batteries are preferably located within the space created by the upper and lower body portions of the sweeper head. Rechargeable batteries are preferably connected to a "jack" 162 via electrical cables (not shown). The electric motor 60 and the batteries 62 can be connected to an ON/OFF switch 64 which allows a user to turn ON or turn OFF the motor as desired. The ON/OFF switch 64 is preferably located on the top portion of the sweeper head 30 in order to be easily accessible by a user. In an even more preferred embodiment, the switch 64 is located in the rear portion of the sweeper head (i.e. the portion the closest to the user's feet during use) such that a user can turn the motor ON and OFF by simply depressing on the switch with the foot.

Figure 6:
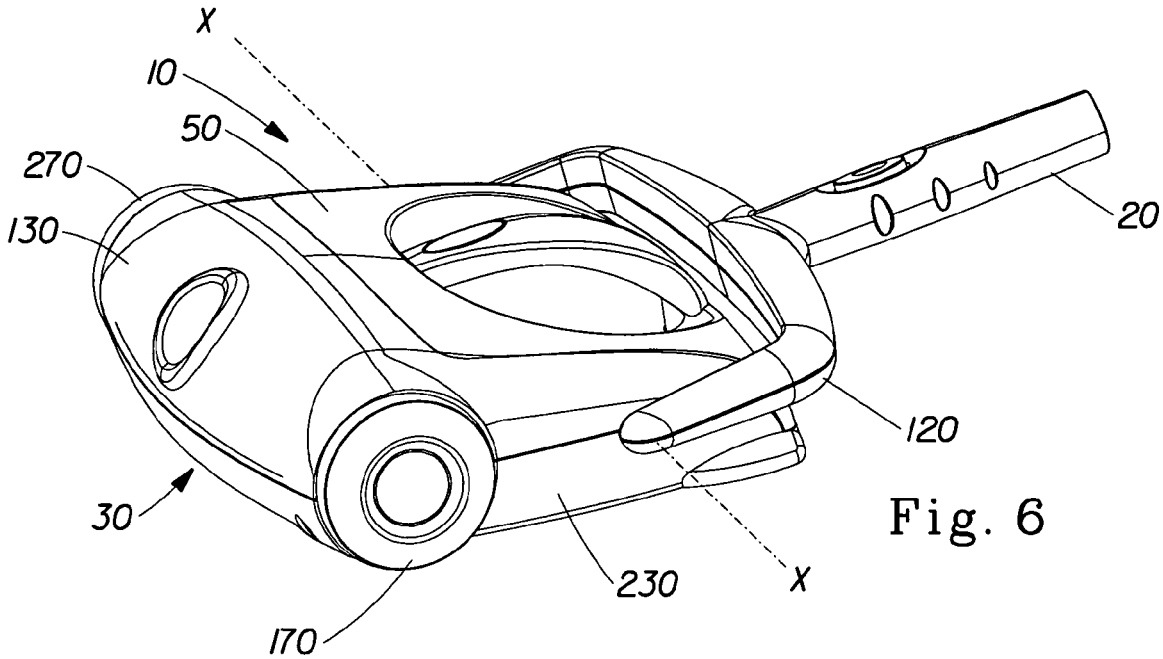
FIG. 6 is a perspective view of another cleaning implement of the invention.
Figure 7:
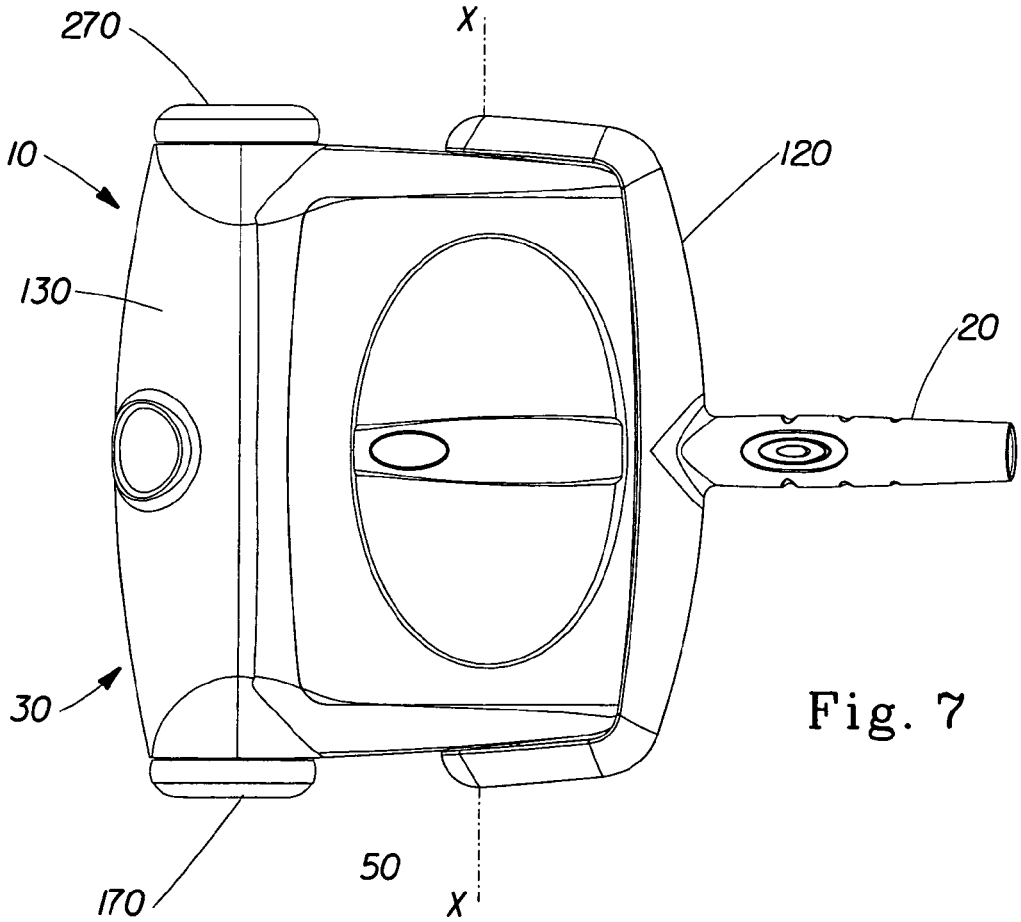
FIG. 7 is a top view of the cleaning implement of FIG. 6.

In another embodiment represented in FIGS. 6 and 7, the cleaning implement 10 is non-motorized and includes a first and a second wheel 170 and 270, which can be operably coupled to the rotating member 40. In a preferred embodiment, the shaft 140 is mechanically connected to at least one but preferably both wheel members 170 and 270 of the sweeper head 30. By "mechanically coupled" it is meant that the rotation of the wheels 170 and/or 270 against the soft surface causes the shaft 140 to rotate about the A-A axis.

In one embodiment, the shaft 140 can be directly or indirectly coupled to at least one but preferably both wheel members 170 and 270 of the sweeper head 30. In a preferred embodiment, the shaft 140 is indirectly coupled to the first and second wheels 170, 270 such that the rotational speed of the rotating member 40 is greater than the rotational speed of the wheel members 170 and/or 270.

Figure 8:
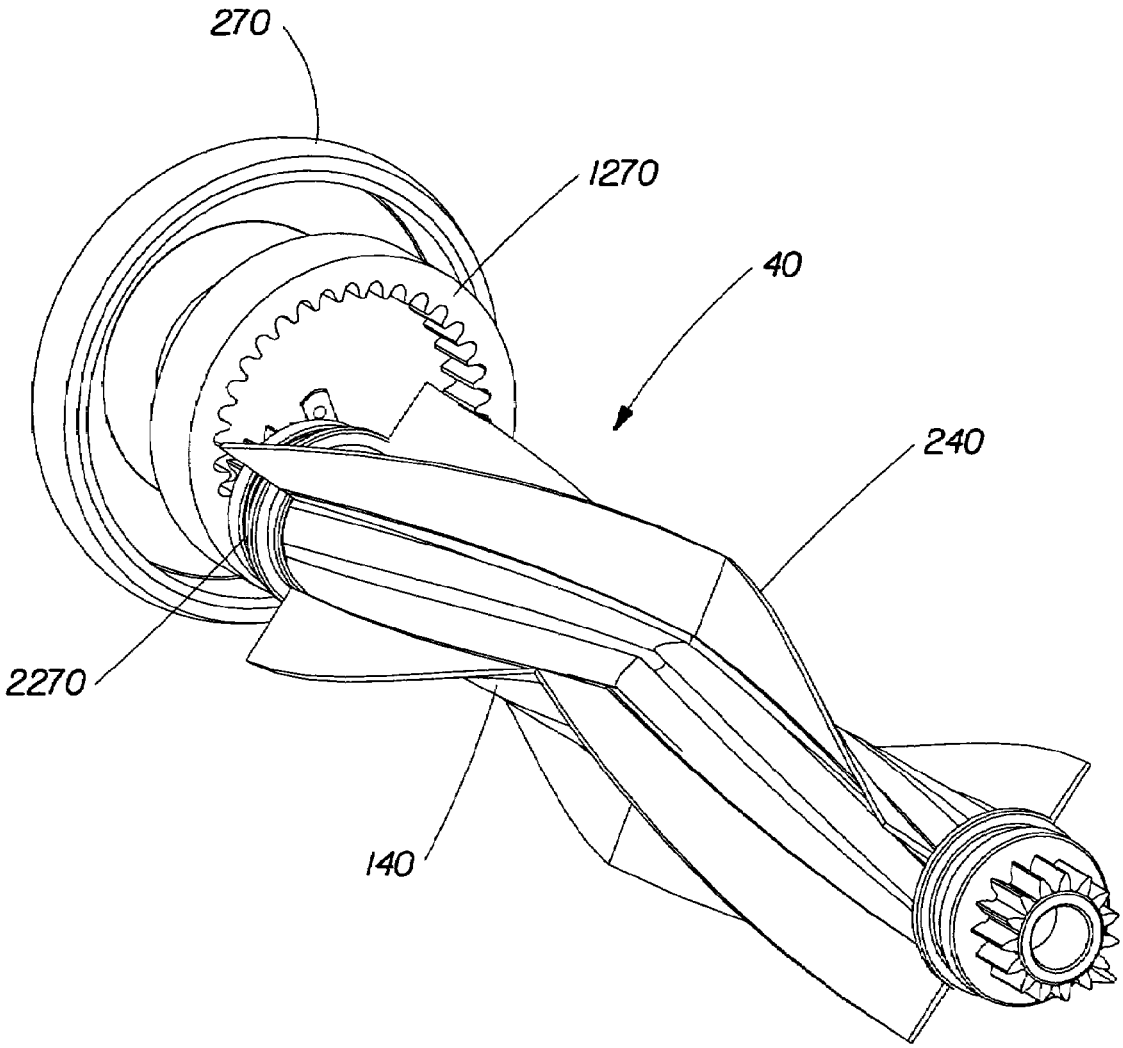
FIG. 8 is a partial perspective view of the rotating member of the cleaning implement of FIG. 6.

FIG. 8 shows a partial view of a suitable gear arrangement (where only one of the wheels is shown for clarity) that allows at least one of the wheels 270 of the sweeper head to rotate the shaft 140. In one embodiment, the wheel 270 is connected to a driving gear 1270 such that the rotational speed of the driving gear 1270 is substantially the same as the rotational speed of the wheel 1270. The driving gear 1270 engages a first transmission gear 2270, which is connected to the shaft 140. In a preferred embodiment, each wheel is connected to a driving gear and each driving gear respectively engages a first and a second transmission gear. When the wheel 270 rotates, the driving gear 1270 causes the transmission gear 2270 to rotate at a rotational speed that depends on the gear ratio between the driving gear and the transmission gear. In one embodiment, this gear ratio is between about 10:1 and about 1:1, preferably between about 8:1 and about 2:1, more preferably between about 5:1 and about 3:1. One skilled in the art will understand that the previously discussed gear arrangement allows the shaft 140 to rotate at a greater rotational speed than the wheels 170 and 270. One skilled in the art will also appreciate that other kind of gear arrangements, such as for example the one previously described in the context of a motorized implement, can be used and still provide the same benefit. It can also be appreciated that in the previous non-motorized embodiment, the rotational speed of the rotating member 40 is directly related to the rotational speed of the wheels 170 and/or 270. When a user moves the sweeper head back and forth across a soft surface, the rotational speed of the wheels varies. As a result, the rotational speed of the shaft 140 and blades 240 is not constant during a typical forward and backward motion of the sweeper head across the soft surface. In addition, the direction of the rotation of the shaft 140 during the forward motion of the sweeper head, is opposite to the direction of the rotation of the shaft 140 during the backward motion of the sweeper head. As a result, loose soils are not consistently flicked or projected towards the collection bin. In order to maximize loose soils removal with the previous non-motorized implement, the rotating member 40 can be located in the middle of the sweeper head 30 and two collection bins can be positioned on each side of the rotating member. The previous embodiment allows the cleaning implement to remove loose soils in both forward and backward directions.

2) Blade Members

As previously discussed, the rotating member 40 includes at least one but preferably a plurality of blade members 240.

Figure 9:
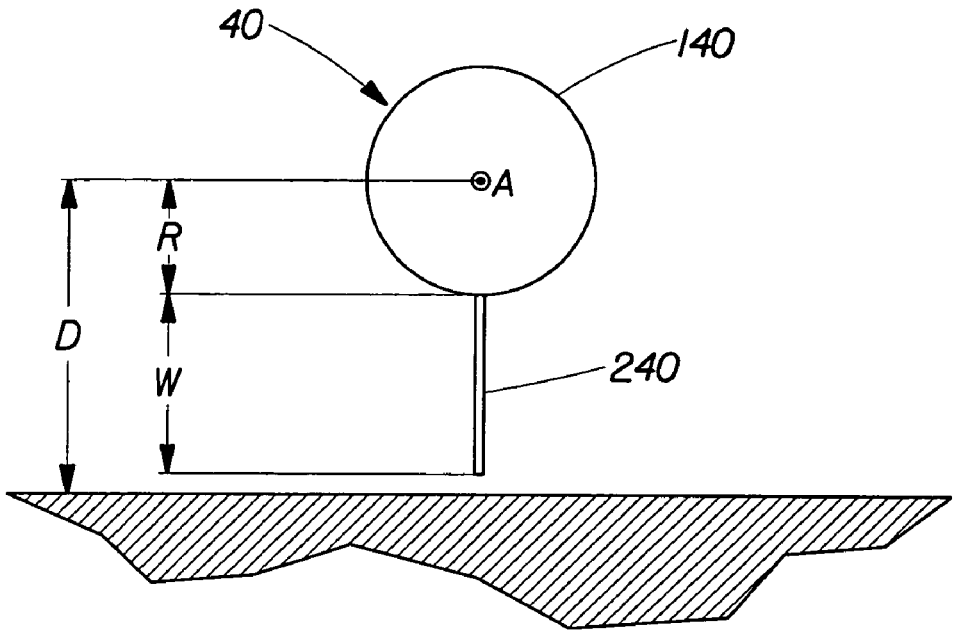
FIG. 9 is a schematic representation of a side view of a rotating member.

In one embodiment, the distance D between the axis A-A and the surface to be cleaned is such that when the shaft 140 and the blade members 240 rotate about the A-A axis, the distal edge 1240 of at least one of the blade members 240 comes adjacent to, and the surface to be cleaned. By "adjacent to the surface to be cleaned", it is meant that the distance between the distal edge 1240 and the surface to be cleaned is between about 0.5 mm and about 15 mm, preferably between about 1 mm and about 10 mm, more preferably between about 2 mm and about 5 mm. An example of a rotating member 40 having a blade member 240 that is adjacent to the surface being cleaned is schematically represented in FIG. 9.

Figure 10:
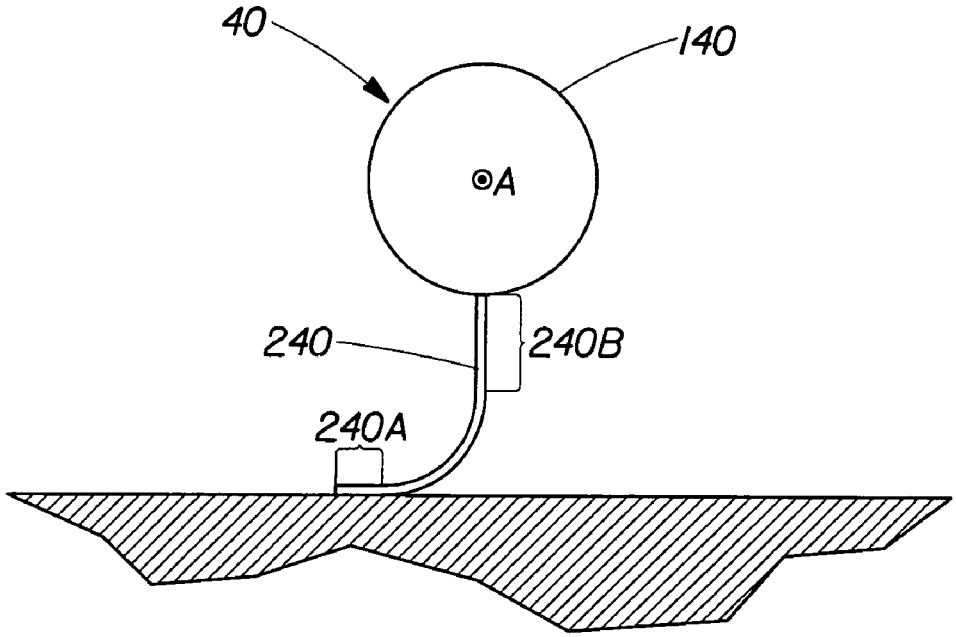
FIG. 10 is schematic representation of a side view of another rotating member.

In one embodiment, at least one of the blade members 240 comes in contact with the surface to be cleaned during the cleaning operation. In a preferred embodiment, the blade members that are capable of contacting the surface to be cleaned are made of a flexible and/or elastic material such that the blade member(s) can bent or be deformed when it contacts the surface being cleaned. In one embodiment, the rotating member 40 can include at least one blade member 240, which is sized such that a distal portion 240A of this blade member contacts the surface being cleaned during the cleaning operation. The length of the portion 240A which will be defined as "blade contact length" can be measured by placing the sweeper head on top of a hard surface, such as a vinyl floor, and then rotate the shaft of the rotating member until the proximal portion 240B of the blade member 240 is located within a plane which is perpendicular to the hard surface and which includes the rotational axis of the shaft member 140. If the blade along the rotational shaft 140 is helical or "V" shaped the measurement is determined at the point on the blade where the greatest amount of "bent length" is achieved when blade contacts the floor. An example of a rotating member 40 having a blade member 240 that contacts the surface being cleaned is schematically represented in FIG. 10. In one embodiment, the distal portion 240A of the blade member 240 is between about 0.5 mm to about 20 mm, preferably from about 1 mm to about 15 mm, more preferably from about 3 mm to about 10 mm of the distal portion of this blade member contacts the surface being cleaned during the cleaning operation.

In one embodiment, the rotating member can include at least a first blade member whose distal edge gets adjacent to the surface to be cleaned without contacting this surface and at least a second blade member capable of contacting the surface to be cleaned during the cleaning operation. In a preferred embodiment the rotating member comprises a plurality of blade members whose distal edge gets adjacent to the surface to be cleaned without contacting this surface and a plurality of blade members capable of contacting the surface to be cleaned during the cleaning operation.

In one embodiment, the rotating member includes between about 1 and about 10, preferably between about 2 and about 8 blade members. In one embodiment, the blade members 240 are symmetrically arranged relative to the shaft 140. The blade members 240 can be made of any material such as metal, wood, plastic or thermoplastic. In a preferred embodiment, the blade members 140 are made of a flexible and elastic material such as rubber. Flexible and elastic materials allow each blade members to reduce the risk of damaging the soft surface when each blade member comes in direct contact with this soft surface.

In one embodiment, the sum of the radius R of the shaft 140 and the width W of a blade member 240 is greater than the distance D between the A-A axis and the top of the soft surface. One skilled in the art will understand that both the diameter R of the shaft 140 and the width W of the blade members can be adjusted to allow the distal portion 1240 of at least one of the blade members 240 to come adjacent to, and preferably to come in contact with the surface to be cleaned. In one embodiment, the width W of at least one of the blade members 240 is at least about 100% longer, preferably at least about 160% longer, more preferably at least about 200% longer and even more preferably at least about 250% longer than the radius R of the shaft 140. One skilled in the art will understand that for any given material used to make the blade members with a constant thickness, a longer blade tends to be more flexible than a shorter blade.

Among other benefits the combination of such shaft and blade members allow a distal portion of the blade members to reach within the fibers of the soft surface to be cleaned and "to extract" or remove a greater amount of loose soils. In addition, when the blade members are made of a flexible and elastic material, the blade members are first bent as they come in contact with the soft surface. As soon as the elastic force of a blade member overcomes the resistive forces of the soft surface, the blade member returns to its original shape due to its elastic properties. When the blade member returns to its original shape, loose soils in the proximity of the blade are flicked or projected into the collection bin 50.

Figure 11:
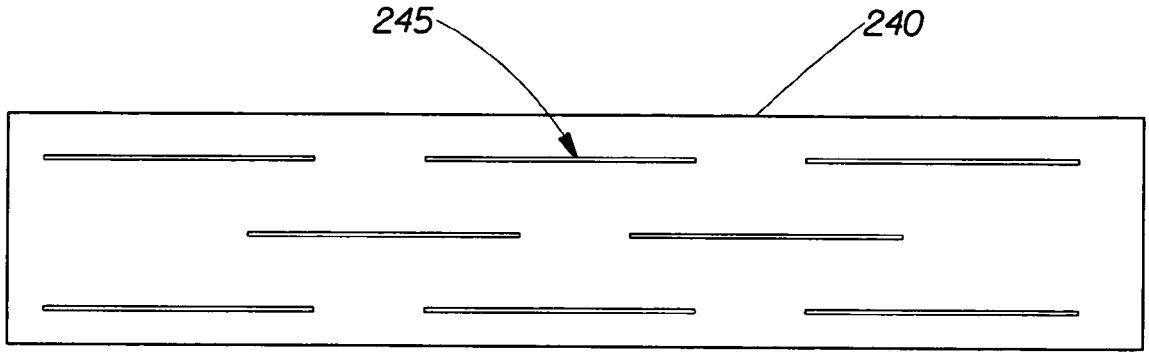
FIG. 11 is schematic representation of a front view of a blade member.
Figure 12:
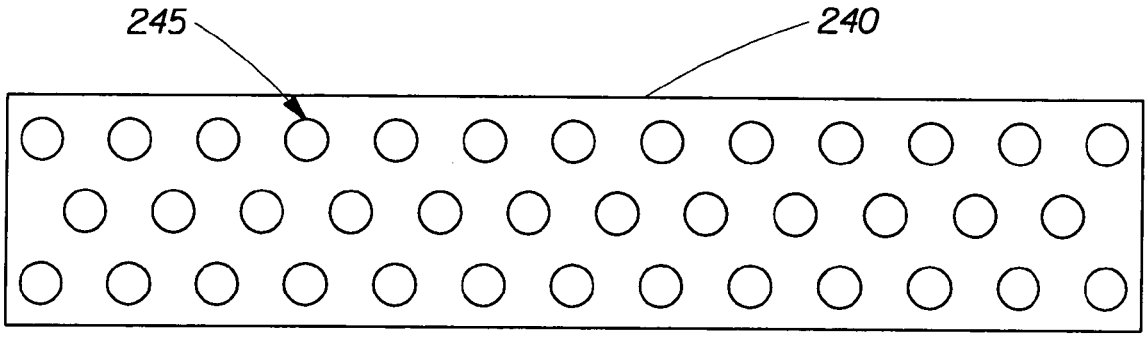
FIG. 12 is schematic representation of a front view of another blade member.
Figure 13:
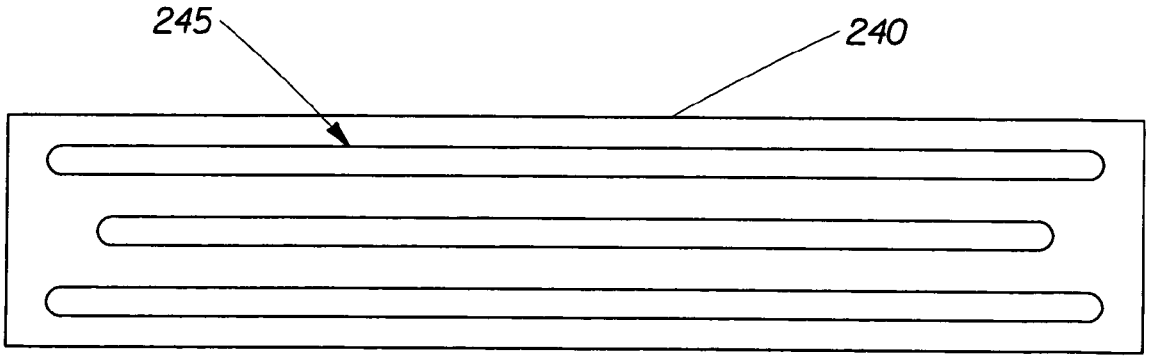
FIG. 13 is schematic representation of a front view of another blade member.

In one embodiment schematically represented in FIGS. 11-13, a blade member(s) 240 can have at least one but preferably a plurality of weaknesses 245 for increasing the flexibility of the blade member(s) 240. In one embodiment, a weakness 245 can be a longitudinal slit or a cut extending at least partially through the thickness of a blade member 240. In a preferred embodiment, a longitudinal slit or cut extends through the whole thickness of the blade member.

In one embodiment a weakness 245 can be bi-dimensional (i.e. create a void volume through the blade). FIG. 12 shows a blade member 240 having a plurality of circular weaknesses extending through the blade member and FIG. 13 shows a blade member 240 having a plurality of bi-dimensional slot extending through the blade member. In a preferred embodiment, the weakness 245 can be a hole extending through the whole thickness of a blade member 240. In one embodiment, a blade member comprises between about 1 and about 1000 holes, preferably between about 10 and about 500 holes, more preferably between about 20 and about 250 holes. The weaknesses and/or holes previously described can be straight, curved, oblique and can have any geometrical shape (circular, oval, square, triangular etc . . . ) known in the art. It has been observed that when the blade members rotate, in particular when their rotational speed exceed 500 rpm, the blade members generate an airflow in front of the sweeper head. This airflow can cause loose soils to be pushed or "blown" in front of the sweeper head. Without intending to be bound by any theory, it is believed that when the sweeper head lies on top of a floor surface, especially a carpet, the upper and lower body portions of the sweeper head form a substantially air tight volume. It is also believed that the only "escape" route or path for the airflow being generated is through the gap between the lower body portion and the surface being cleaned. It has been found that in addition to increasing the flexibility of a blade member, weaknesses (and in particular holes) provide an air-vent that allows air to circulate through the blade members and, as a result, minimize the airflow generated by the rotation of the blade members.

The blade member(s) 240 can be connected to the shaft 140 via any method know in the art. In one embodiment, the blade member(s) can be adhesively attached to the shaft 140. In a preferred embodiment, the shaft 140 comprises a plurality of grooves for retaining at least a proximal portion of the blade members.

Figure 14:
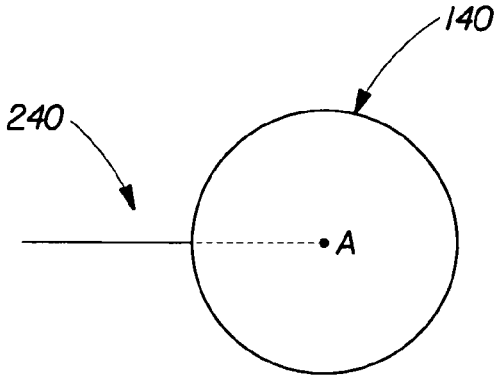
FIG. 14 is a schematic representation of a side view of a rotating member.

In one embodiment schematically represented in FIG. 14, the blade members 240 extend radially from the shaft 140.

Figure 15:
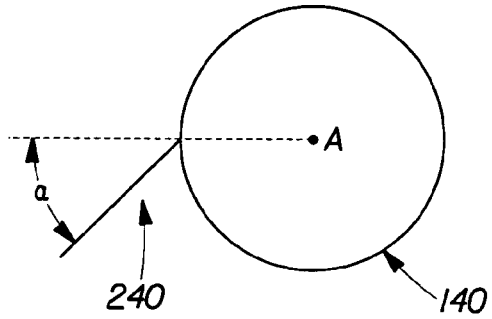
FIG. 15 is schematic representation of a side view of another rotating member.

In on embodiment schematically represented in FIG. 15, the blade members 240 extend from the shaft 240 at an angle $\alpha$ of between about 0 and about 90 degrees relative to the radius R of the shaft 140.

Figure 16:
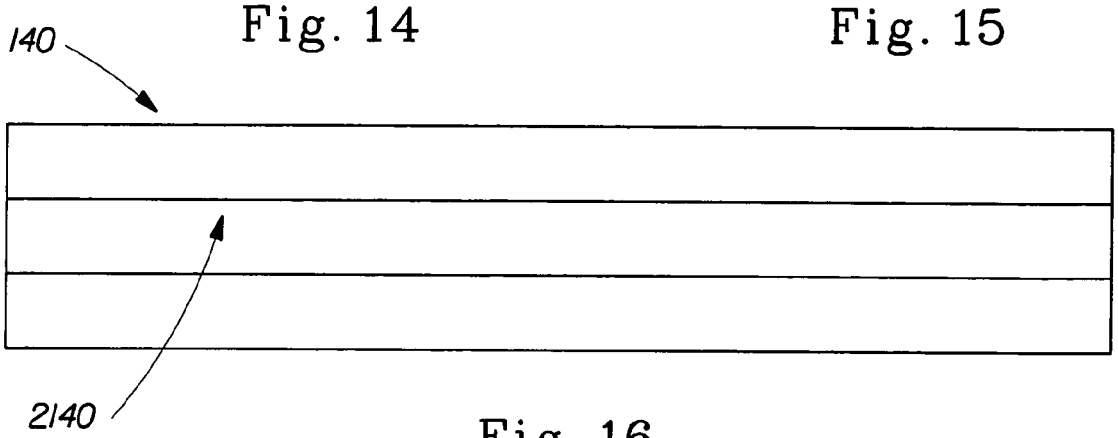
FIG. 16 is schematic representation of a front view of a rotating member.

In one embodiment shown in FIG. 16, the blade members 240 can extend from the shaft 140 along a continuous straight line 2140.

Figure 17:
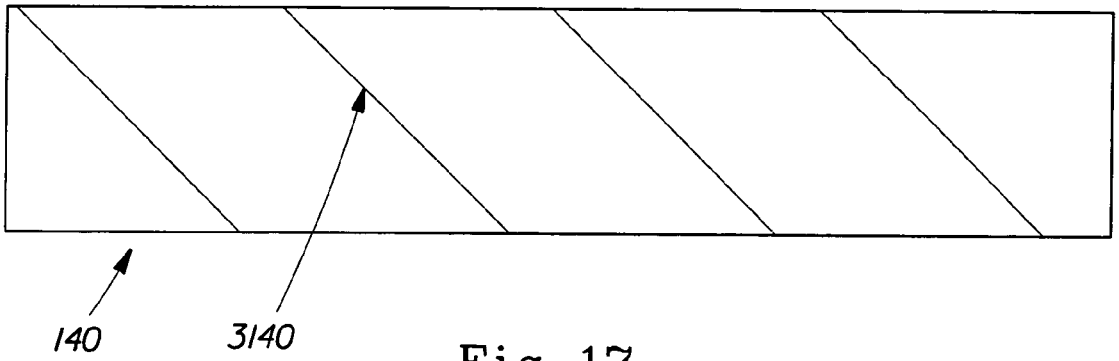
FIG. 17 is schematic representation of a front view of another rotating member.

In one embodiment shown in FIG. 17, the blade members 240 can extend from the shaft 140 along a continuous helicoidal line 3140.

Figure 18:
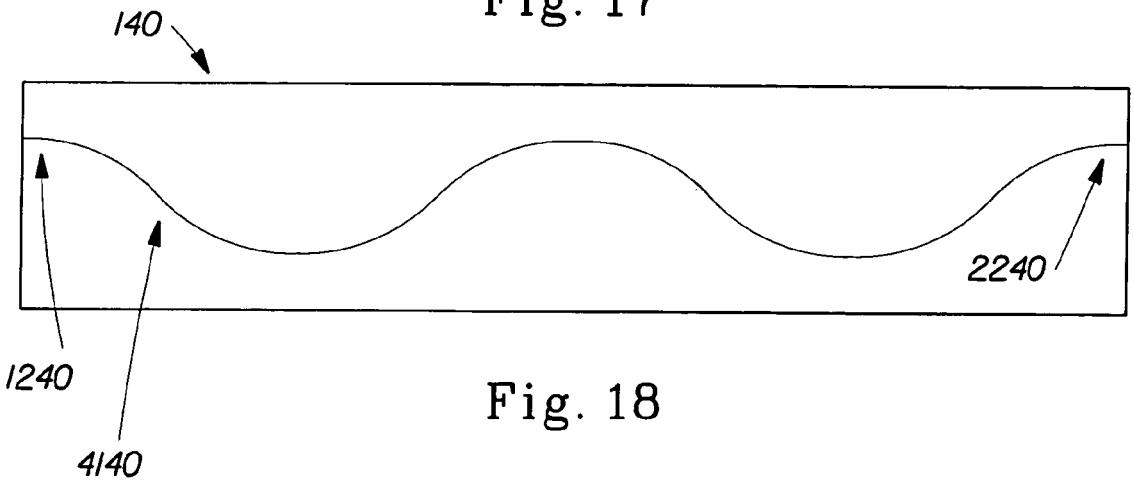
FIG. 18 is schematic representation of a front view of another rotating member.
Figure 19:
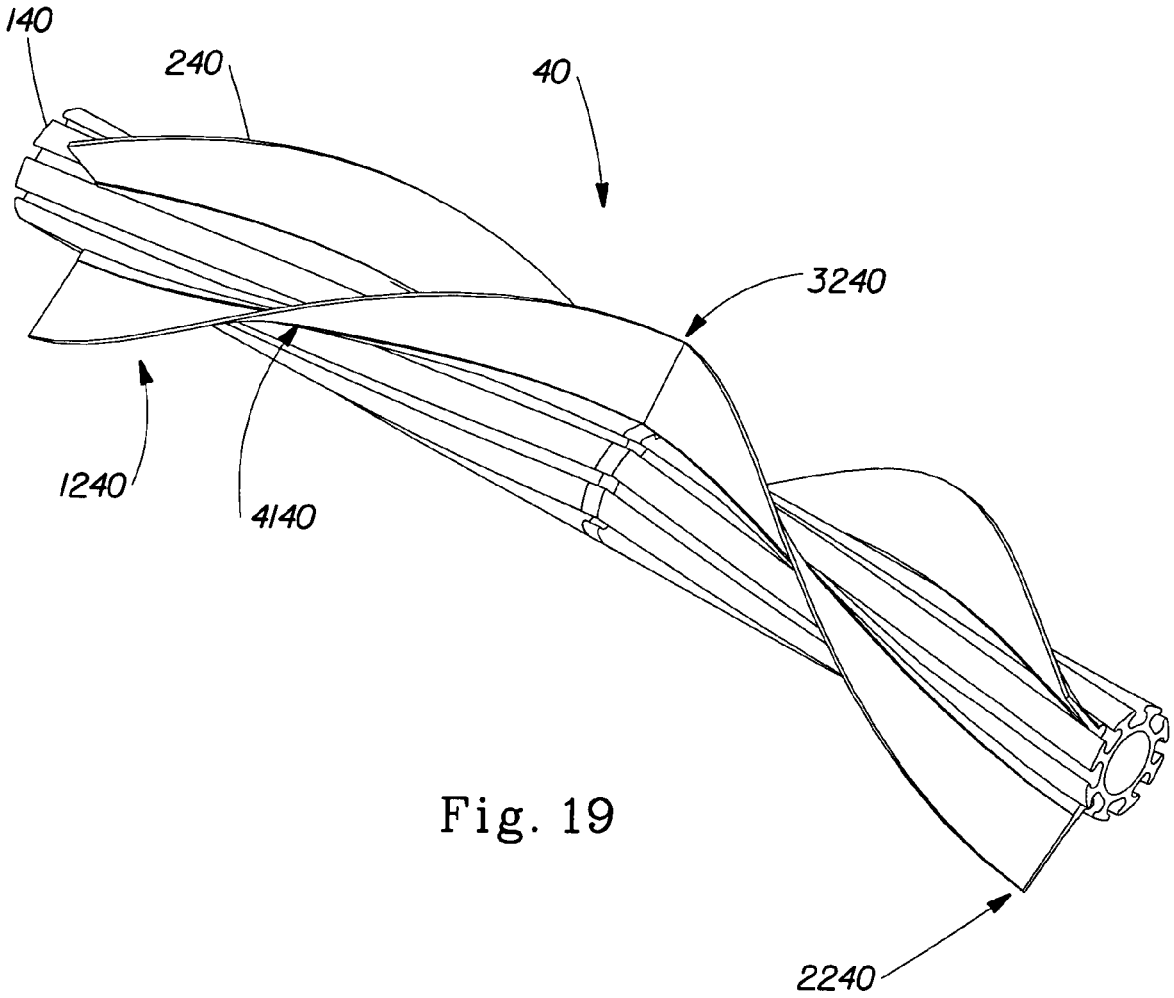
FIG. 19 is a perspective view of a rotating member.

In a preferred embodiment shown in FIGS. 18 and 19, the blade members 240 extend from the shaft 140 along a sinusoidal line 4140. By "sinusoidal line" it is meant that the line includes at least one inflection point or apex from where the line changes direction. In one embodiment, the blade members 240 have substantially a V or U shape such that the "tip" or apex of the V is located substantially at equal distance for both ends of the shaft 140. Among other benefits, a V shape blade member increases the ability of the blade to flick or project loose soil, and in particular "heavier" or large loose soil, into the collection bin 50. V shape blade members are preferably connected to the shaft 140 such that when the shaft and V shape blade members rotate about the A-A axis, the outward portions 1240 and 2240 of the V shape blade come in contact with the soft surface before the tip or apex portion 3240 of the blade comes in contact with the soft surface. Among other benefits, the previous V shape blade members allows the rotating member 40 to bring loose soils, in particular "heavier" or larger loose soils towards the center portion of the sweeper head. During the "transfer" of the loose soils from the outward portions 1240 and 2240 to the "tip" 3240, these loose soils gain in speed. Once the loose soils reach the "tip" or apex of the V shape blade, these are flicked or projected into the collection bin 50.

3) Collection Bin

As previously discussed, the sweeper head 30 includes a collection bin 50 for receiving and containing loose soils removed by the rotating member 40 from the soft surface during the cleaning operation.

Figure 20:
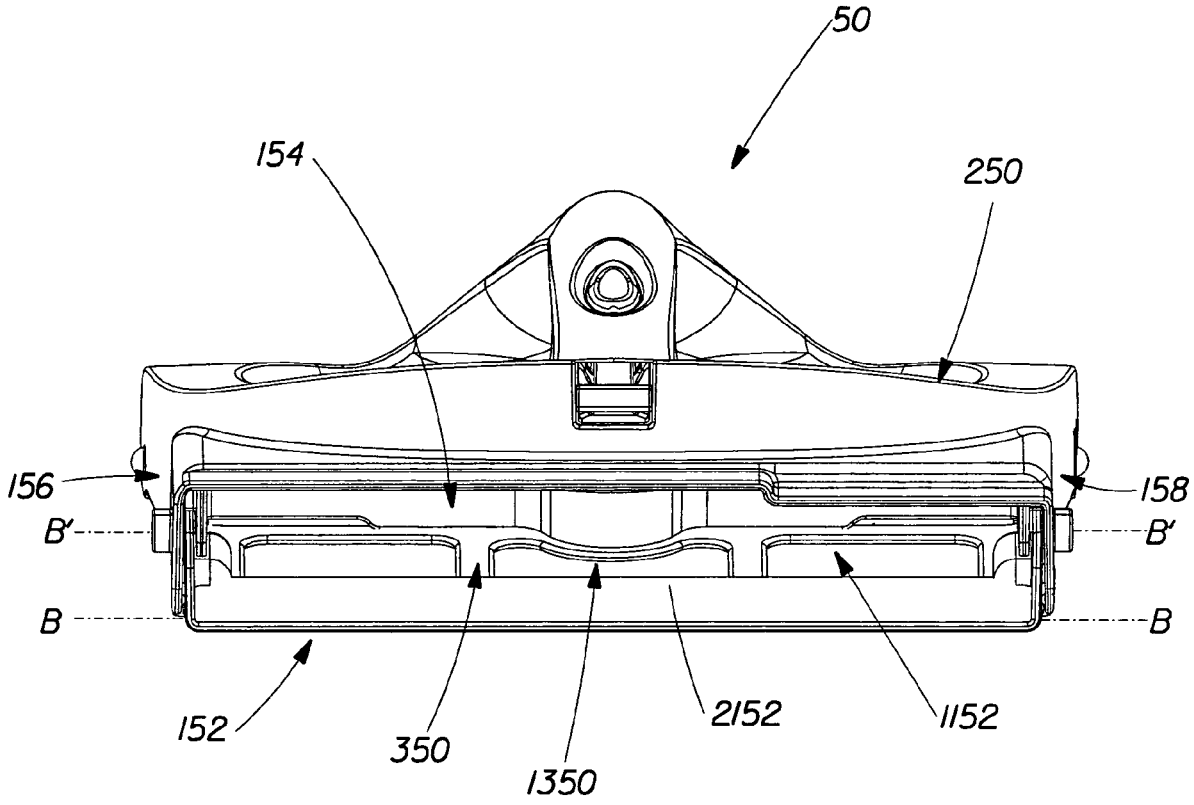
FIG. 20 is a front view of a collection bin of the invention.

In one embodiment shown in FIG. 20, the collection bin 50 comprises a front, back and side walls, respectively 152, 154, 156 and 158, which are corrected to a top wall 250 and a bottom wall 350.

In one embodiment, the front wall 152 has at least one opening 1152 for allowing loose soils, which are flicked or projected by the rotating member 40, to get inside the collection bin 50. One skilled in the art will understand that the same benefit can be achieved by providing a collection bin, which does not include a front wall. In a preferred embodiment, the opening 1152 is located away from the bottom wall 350 such that a lower portion 2152 of the front wall 152 forms a barrier preventing loose soils from coming out of the collection bin 50 accidentally. The opening 1152 is large enough to maximize the chances that loose soils, which are flicked or projected by the rotating member, are capable of getting into the collection bin without being obstructed by the lower portion 2152 of the front wall 152. In one embodiment, the area of the opening 1152 is between about 1 $cm^2$ and about 100 $cm^2$, preferably between about 30 $cm^2$ and about 60 $cm^2$.

In one embodiment, the lower portion 2152 of the front wall 152 is substantially perpendicular to the surface being cleaned. In a preferred embodiment, the angle $\beta$ (shown in FIG. 4) between the surface to be cleaned and the lower portion 2152 of the front wall 152 is between about 0 and about 90 degrees, preferably between about 2 and about 20 degrees. One skilled in the art will understand that when the angle $\beta$ between the surface being cleaned and the lower portion 2152 of the front wall 152 is equal to or greater than 90 degrees, any loose soil, which hits the lower portion 2152, bounces back towards the rotating member 30 and is not "trapped" into the collection bin 50 right away. When the lower portion 2152 of the front wall 152 is oriented towards the back wall 154 (i.e. when $\beta$ is less than 90 degrees), the lower portion 2152 forms a ramp for the loose soils which are projected towards the opening 1152. Loose soils, which hit the lower portion 2152 have a greater chance/probability to be deflected towards the opening 1152 and, as a result, have a greater chance to be "trapped" by the collection bin.

In an even more preferred embodiment, the lower portion 2152 is pivotably connected to one of the side, top or bottom walls about a B-B pivot axis such that when the collection bin is tilted towards the floor surface (i.e. the opening 1152 faces downwards) the lower portion 2152 pivots towards the opening 1152 due to its own weight and closes at least a portion but preferably the whole opening 1152. In a preferred embodiment, Among other benefits, a pivotable lower portion can prevent loose soils from coming out of the collection through the opening 1152 when the cleaning implement is lifted up from the soft surface and the front of the sweeper head faces the floor.

In one embodiment, the bottom wall 350 of the collection bin 50 comprises at least one, but preferably a plurality of openings 1350. As previously discussed, the cleaning implement is preferably used with a disposable cleaning substrate. In this embodiment, a cleaning substrate can be attached to the sweeper head and/or the collection bin 50 such that the substrate covers at least partially, but preferably entirely, the opening(s) 1350 of the bottom wall 350. In an even more preferred embodiment, a cleaning substrate can be attached to the sweeper head and/or the collection bin 50 such that the top surface of the cleaning substrate is in contact with the bottom surface of the bottom wall 350. When the bottom wall 350 of the collection bin 50 includes at least one opening 1350 and the cleaning substrate covers at least partially the opening 1350, loose soils (previously projected by the rotating member into the bin) are prevented from getting back onto the soft surface through the opening 1350. During the cleaning operation, loose soils, which are flicked or projected into the collection bin 50, fall onto the top surface of the cleaning substrate (i.e. the surface of the substrate that is distal from the floor). Among other benefits, the opening 1350 through the bottom wall 350, allows a user to empty the content of the collection bin and remove the cleaning substrate simultaneously. After the cleaning operation, a user can place the sweeper head and/or the collection bin, above a trashcan with the cleaning substrate still covering the opening(s) 1350. When the user removes the cleaning substrate, the loose soils fall by gravity into the trashcan. The user can then drop the cleaning substrate into the trashcan. One skilled in the art will understand that a collection bin which does not include a bottom wall (i.e. includes a large opening) can provides the same benefits. One skilled in the art will also understand that a collection bin 50 which does not include a bottom wall 350 but instead includes a lower opening provides the same benefits.

In one embodiment, the bottom wall 350 can be pivotably connected to one of the front, back or side walls, 152, 154, 156 or 158. In a preferred embodiment, the bottom wall 350 is pivotably connected to the back wall 154 of the collection bin 50 about a pivot axis B'-B'. A bottom wall 350 pivotably connected to one of the front, back or side walls, provides an easy access to the inner volume of the collection bin 50 by pulling the bottom wall 350 downwards. In addition, a bottom wall 350 pivotably connected to one of the front, back or side walls, can also be used to secure a cleaning substrate to the collection bin 50.

Figure 21:
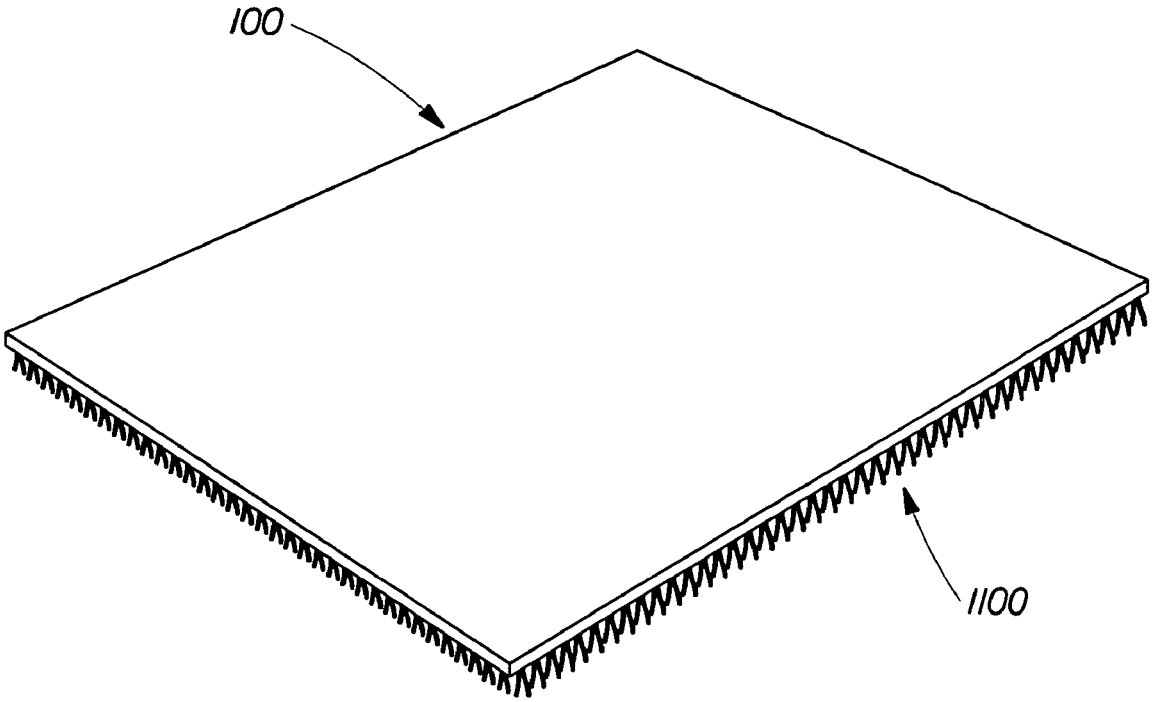
FIG. 21 is a perspective view of a disposable cleaning substrate of the invention.
Figure 22:
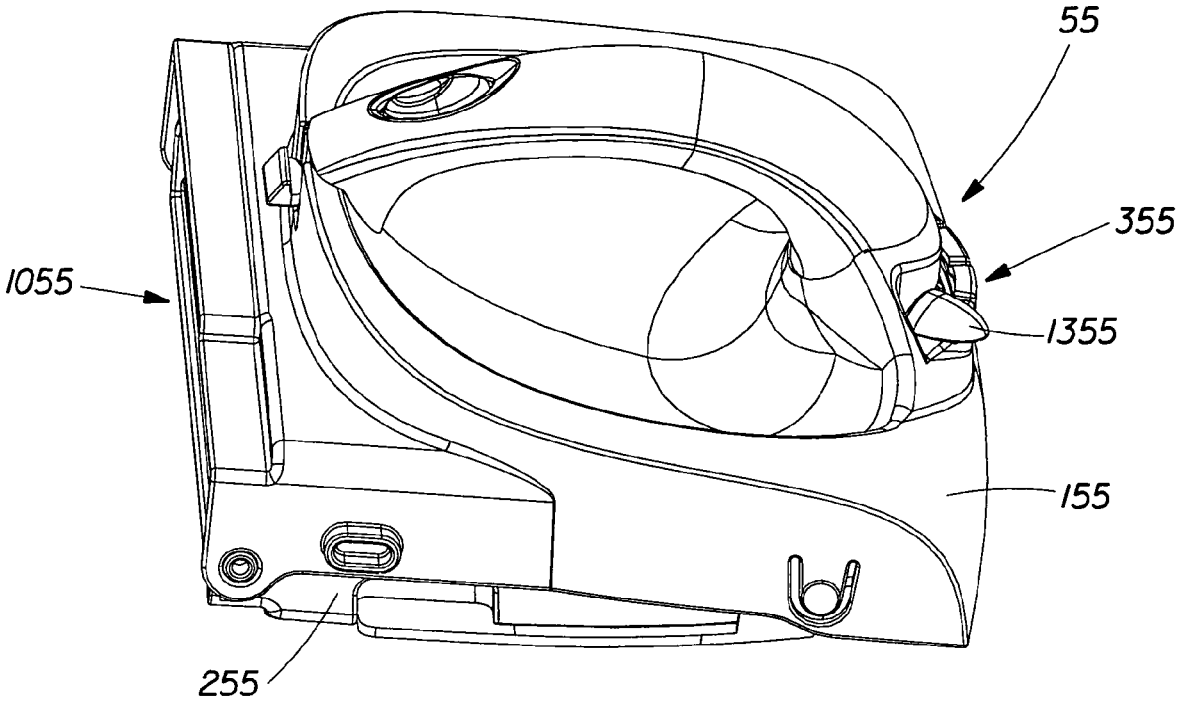
FIG. 22 is a perspective view of the collection bin of FIG. 20.
Figure 23:
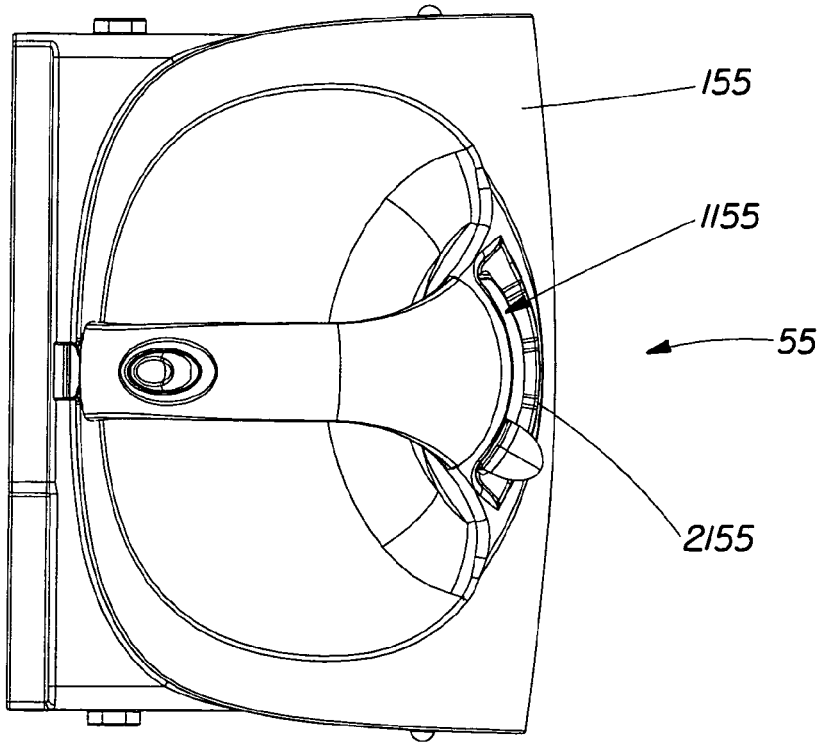
FIG. 23 is a top view of the collection bin of FIG. 20.
Figure 24:
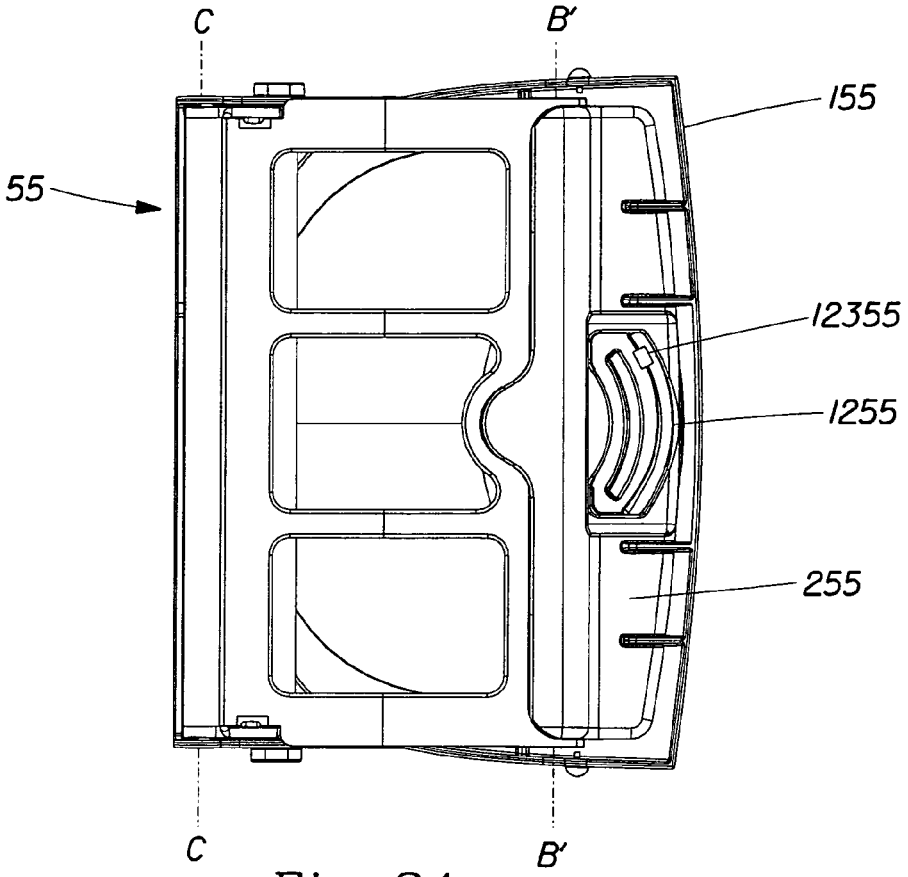
FIG. 24 is a bottom view of the collection bin of FIG. 20.
Figure 25:
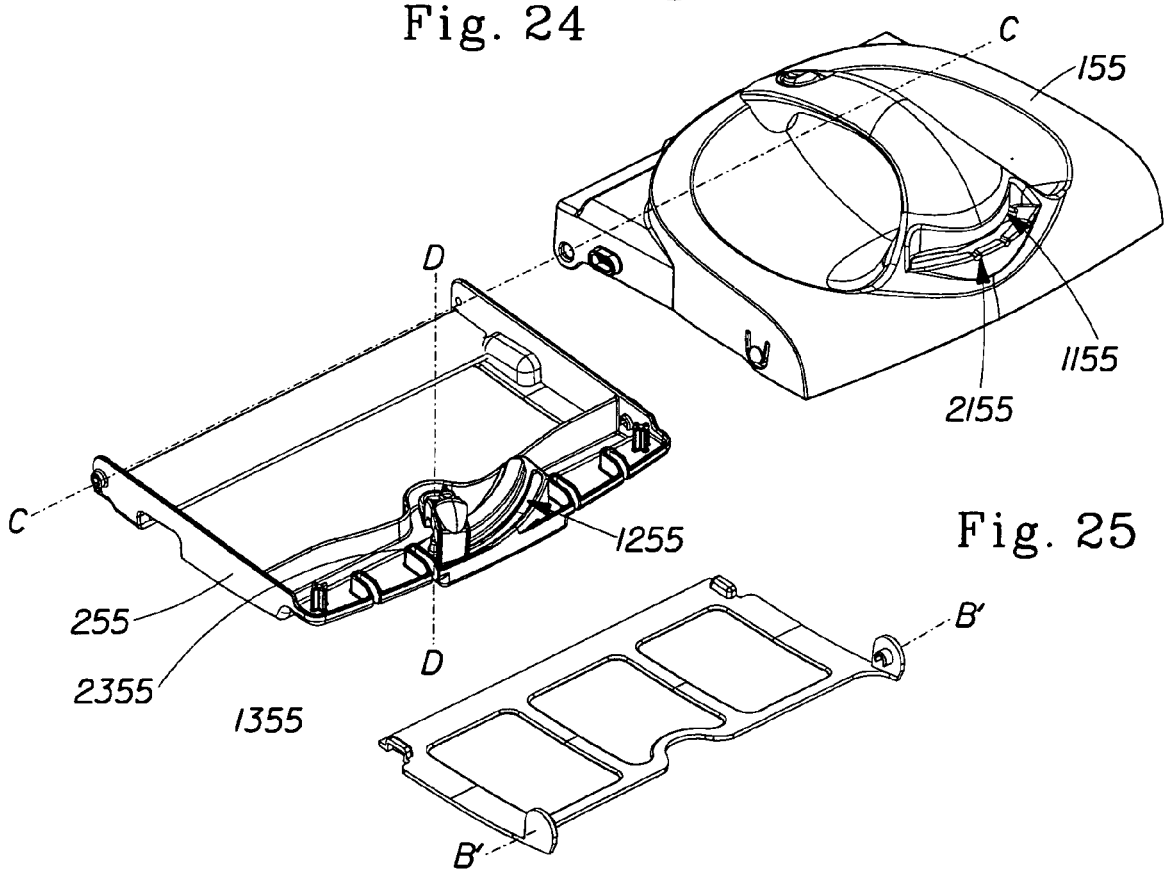
FIG. 25 is an exploded view of the collection bin of claim 20

The cleaning implements previously discussed are preferably used with a disposable cleaning substrate or sheet 100 schematically represented in FIG. 21, which is removably affixed to the implement such that at least a portion of the cleaning substrate contacts the soft surface during the cleaning operation.

In a preferred embodiment, a disposable cleaning substrate or sheet 100 which includes protrusions 1100 extending from the bottom surface of the substrate 100, is affixed to the implement such that at least some of the protrusions come in contact with the surface to be cleaned. During the cleaning operation, and in particular during the cleaning of a carpet surface, some of the protrusions of the sheet reach within the carpet and, as a result, are capable of removing or "extracting" from the carpet soils capable of entanglement. It has been observed that while a cleaning sheet with protrusions can be moved easily across the surface of a first carpet, it can be particularly difficult to move the same sheet across a second carpet having different properties than the first carpet. Carpets found in households vary widely in terms of thickness, density, carpet fibers length and age (i.e. new v. old or worn/damaged carpet).

In one embodiment, the number of protrusions on the substrate or sheet, the length or height of the protrusions as well as the flexibility of the protrusions can be adjusted in order to provide different cleaning sheets that can be used to clean different type of carpets.

In a preferred embodiment, identical cleaning sheets can be used to clean different type of carpets. It has been found that rather than providing different types of cleaning sheets, identical cleaning sheets can be used to clean various types of carpet when the position of the sheet relative to the carpet being cleaned is adjustable.

In one embodiment, the height of at least a portion of the collection bin relative to the surface to be cleaned, can be adjusted by a user in order to increase or decrease the contact surface between the disposable cleaning substrate and the carpet being cleaned. In a preferred embodiment, a cleaning sheet can be affixed to the cleaning implement having a "height adjustable" collection bin. By "height adjustable collection bin" it is meant that at least a portion of the collection bin is controllably movable between at least a first and a second position. When this "height adjustable" portion of the collection bin is moved from a first to a second position, it is understood that this portion of the bin is moved towards the surface to be cleaned (i.e. downwards). Reciprocally, when this portion of the collection bin is moved from the second to the first position, it is understood that this portion of the bin is moved away from the surface to be cleaned (i.e. upwards). The cleaning substrate or sheet 100 is preferably affixed to the sweeper head and/or the height adjustable collection bin such that the top side or surface of the sheet is substantially adjacent to the bottom wall 350 of the collection bin 50.

FIGS. 22-25 respectively show a perspective, a top, a bottom and an exploded view of a preferred example of a "height adjustable" collection bin 55.

Without intending to be bound by any theory, it is believed that a height adjustable collection bin significantly reduces the risk that the protrusions of the sheet get caught or snagged in the carpet fibers. It is also believed that when the height of the bin is adjustable but the height of sweeper head relative to the surface being cleaned does not change, the blade members of the rotative member keep projecting loose soils into the collection bin.

In one embodiment, the "height adjustable" collection bin comprises an upper chassis member 155 and a lower chassis member 255, which is movable from a first to a second position (and vice versa) relative to the upper chassis member 155. In one embodiment, the lower chassis member 255 is pivotably connected to the upper chassis member 155 about a rotational axis C-C. In a preferred embodiment, the rotational axis C-C is adjacent to the opening 1055 of the bin 55, which allows loose soils to get into the bin 55. One skilled in the art will understand that the back portion of the lower chassis member 255 (i.e. away from the opening 1055) can move upwards or downwards relative to the upper chassis member 155.

In one embodiment, the collection bin 55 can include a height adjustment mechanism 355 that is operably connected to the upper and lower chassis member 155 and 255 and which allows a user to adjust the location of the lower chassis member 255 relative to the upper chassis member 155. In one embodiment, the height adjustment mechanism 355 comprises a lever member 1355 operably connected to the upper chassis member 155 and a transfer member 2355 operably connected to the lower chassis member 255. In one embodiment, the lever member 1355 is positioned within an opening 1155 located on the back portion of the upper chassis member 155. In a preferred embodiment, the lever member 1355 is connected to the upper chassis member such that it can be moved from a first to a second position, within a horizontal plane and without any substantial vertical movement. In one embodiment, the lever member 1355 is attached to the transfer member 2355, which is positioned within an opening 1255 located on the back portion of the lower chassis member 255. In a preferred embodiment, the transfer member 2355 is pivotably connected to the lower chassis member 255 about a rotational axis D-D such that when the lever member 1355 is moved from a first to a second position, the transfer member pivots about a substantially vertical axis (i.e. substantially perpendicular to the surface to be cleaned) within the opening 1255 of the lower chassis member 255. In a preferred embodiment, the transfer member 2355 comprises a lip portion 12355, which is in contact with and supports the lower chassis member 255. In an even more preferred embodiment, the opening 1255 of the lower chassis member 255 is slopped downward such that rotation of the transfer member 2355 causes the back portion of the lower chassis member 255 to move up or down. One skilled in the art will understand that the height adjustment mechanism coverts the rotation of the lever member into a linear vertical motion of the lower chassis member.

Figure 26A:
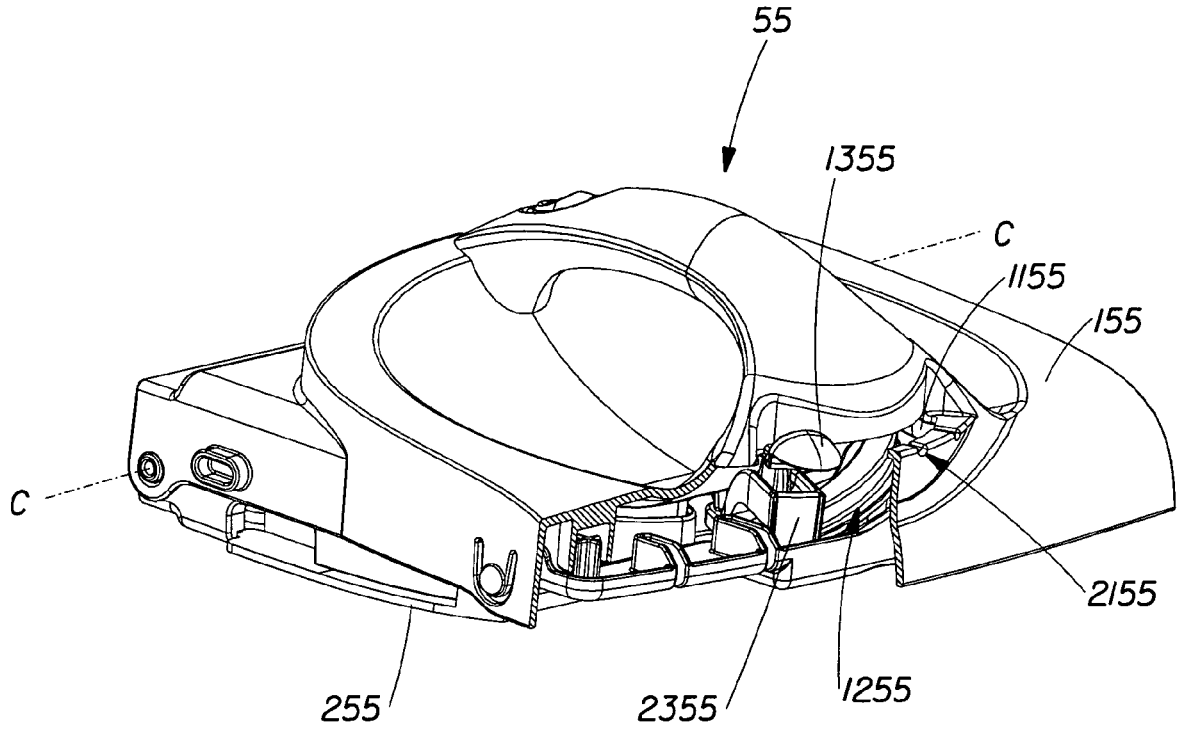
FIG. 26A is a partial view of a height adjustable collection bin in a first position.
Figure 26B:
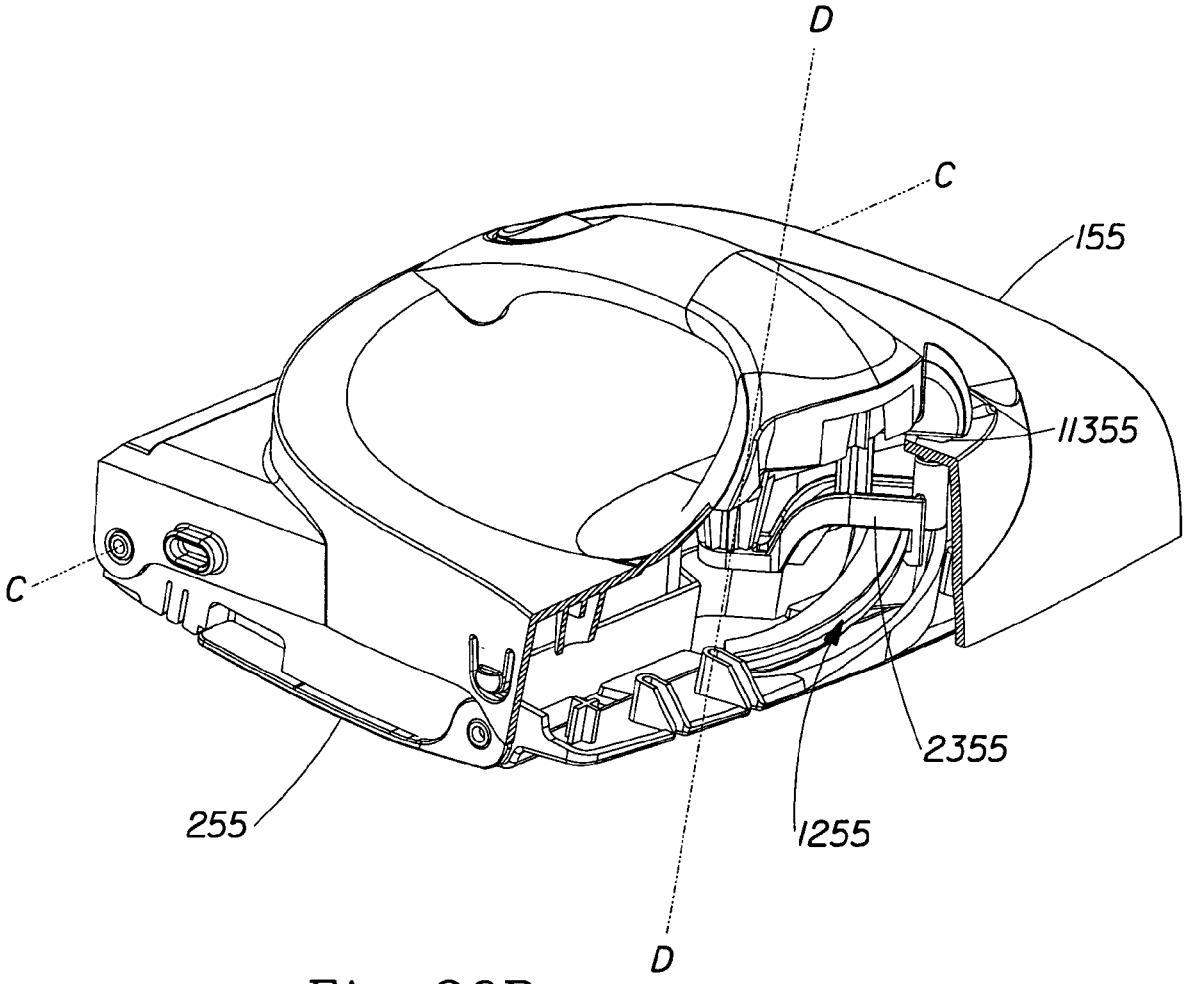
FIG. 26B is a partial view of the height adjustable collection bin of FIG. 26A in a second position.

FIGS. 26A and 26B show the height adjustable collection bin 55 in a first and a second position.

When a user moves the lever member from the first to the second position, the lower chassis member 255 moves downward. Conversely, when a user moves the lever from the second back to the first position, the lower chassis member 255 moves upward.

One skilled in the art will understand that since the front portion of the lower chassis is pivotably connected to the upper chassis and because the lower chassis is supported by the transfer member 2355, the back portion of the lower chassis can move closer (i.e. up) or away (i.e. down) from the upper chassis member 155.

It can be appreciated that the collection bin can have more than two positions in order to provide more height adjustment possibilities to a user.

In one embodiment, the height adjustable bin 55 can have tour positions that a user can choose from depending on the type of carpet he or she wishes to clean. In one embodiment, the lever member 1355 can have a projection for engaging at least one of a plurality of corresponding recesses 2155 located on the upper chassis member 155.

Figure 27A:
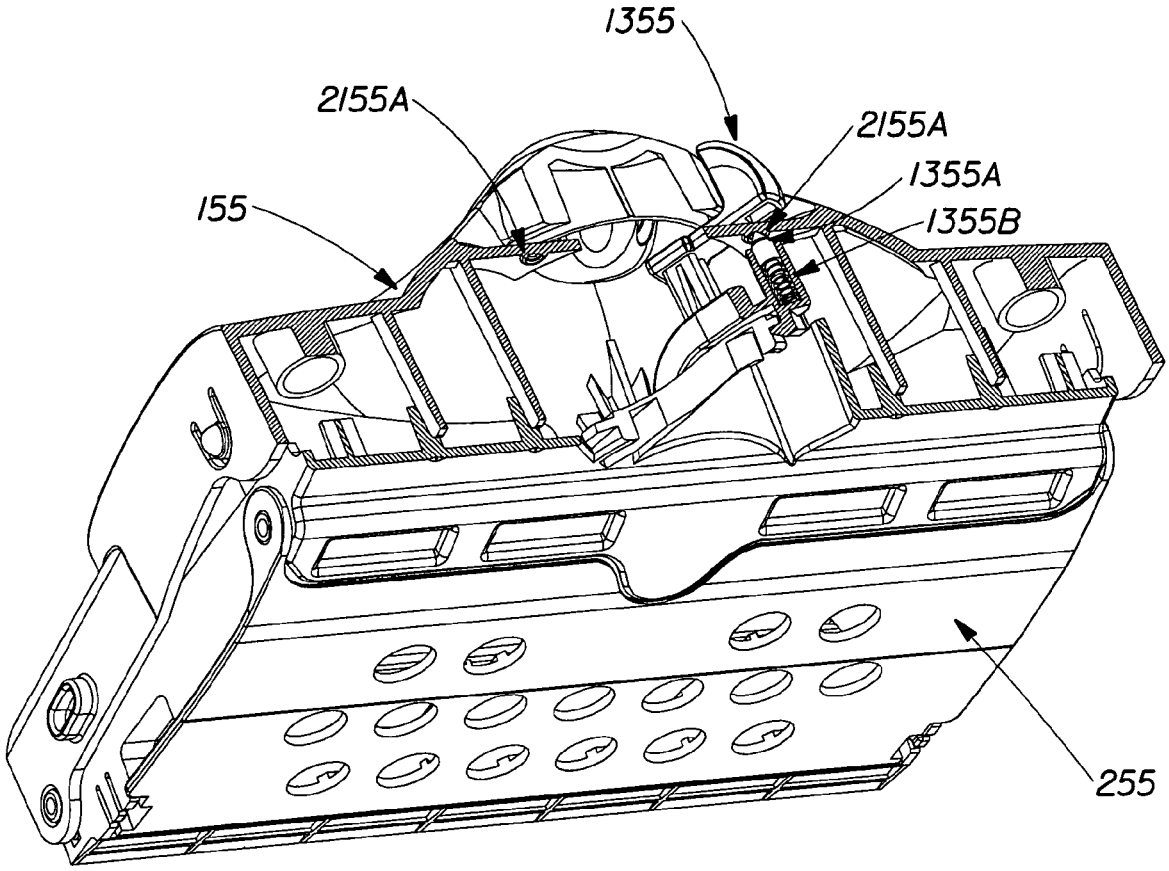
FIG. 27A is a partial view of another height adjustable bin of the invention.

In one embodiment shown in FIG. 27A, the transfer member 2355 that, is connected to the lever member 1355 can include a pin 2355A free to move axially within a hollow cylindrical portion of the lever member and forced upwards by a spring 2355B located within the hollow cylindrical portion. The pin 2355A can engage one of a plurality of recesses 2155A formed within the inner surface of the upper chassis 155. When a user moves the lever member 1355 from a set position to a second position, the spring loaded pin 2355A disengages one of the recesses 2155A until it engages the following recess while emitting an audible sound which indicates that the height adjustable bin is in another position. Among other benefits, the spring loaded pin prevents the lever member 1355 and the height adjustable bin from changing position accidentally during the cleaning operation.

As previously discussed, the cleaning implement can be used to clean either soft surfaces or hard surfaces. When the cleaning implement is used to clean a hard surface, the implement can be used with a disposable cleaning sheet including a nonwoven material such as a SWIFFER® (from The Protect & Gamble Company) or PLEDGE GRAB-IT® (from the S.C. Johnson Company) cleaning sheet that can be attached to the bottom surface of the sweeper head. A collection bin having a height adjustment mechanism as previously described, allows the cleaning sheet to be put in proximate contact with the hard surface being cleaned such that the disposable cleaning sheet is wiped across the hard surface.

Figure 27B:
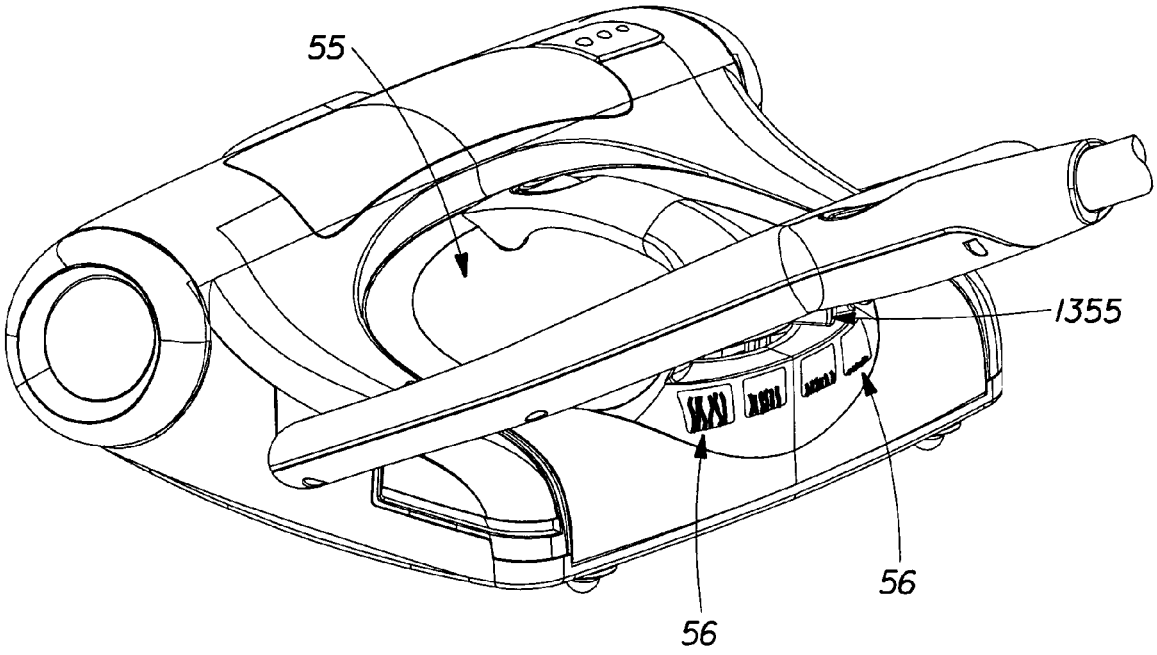
FIG. 27B is a perspective view of a cleaning implement with the height adjustable bin if FIG. 27A.

In one embodiment shown in FIG. 27B, the height adjustable bin 55 comprises at least one, preferably at least two of indicia 56 in the form of icons, pictures, words, symbols, and any combinations thereof, that are located substantially adjacent to the lever member 1355 in order to convey to the user the proper positioning of the lever member 1355 depending on the type of soft surface being cleaned. In a preferred embodiment, the number of indicia is equal to the number of position the lever member can have. In a preferred embodiment, the indicia 56 schematically represent a side view of carpet fibers having different sizes. For optimal cleaning performance, the carpet side view showing the "shortest" fibers is preferably adjacent the lever member's position where height adjustable bin and, as a result the cleaning sheet, are the closest to the carpet surface (i.e. the lowest position). Conversely, the carpet side view showing the "longest" fibers is preferably adjacent the lever member's position where height adjustable bin and, the cleaning sheet, are the furthest away the carpet surface (i.e. the highest position). The lever member can have as many intermediate positions as desired but it is believed that two intermediate positions in combination with a lowest and a highest position provide sufficient height adjustment variability based on the type of carpets typically found in houses. In a preferred embodiment, the collection bin also includes an indicia conveying to the user the proper positioning of the lever member when the cleaning implement is used to clean a hard surface. One skilled in the art will understand that when cleaning a hard surface with a disposable cleaning sheet such as the SWIFFER® cleaning sheet, it is beneficial that the cleaning sheet is in close contact with the hard surface. Consequently, the indicia associated with hard surface cleaning is preferably adjacent to the position of the lever member where the height adjustable bin is the closest to the surface to be cleaned.

In one embodiment, similar indicia can also be included on the package in which the cleaning implement is sold, on the package in which the disposable cleaning sheets are being sold, in an instruction manual and any combinations thereof.

Figure 28:
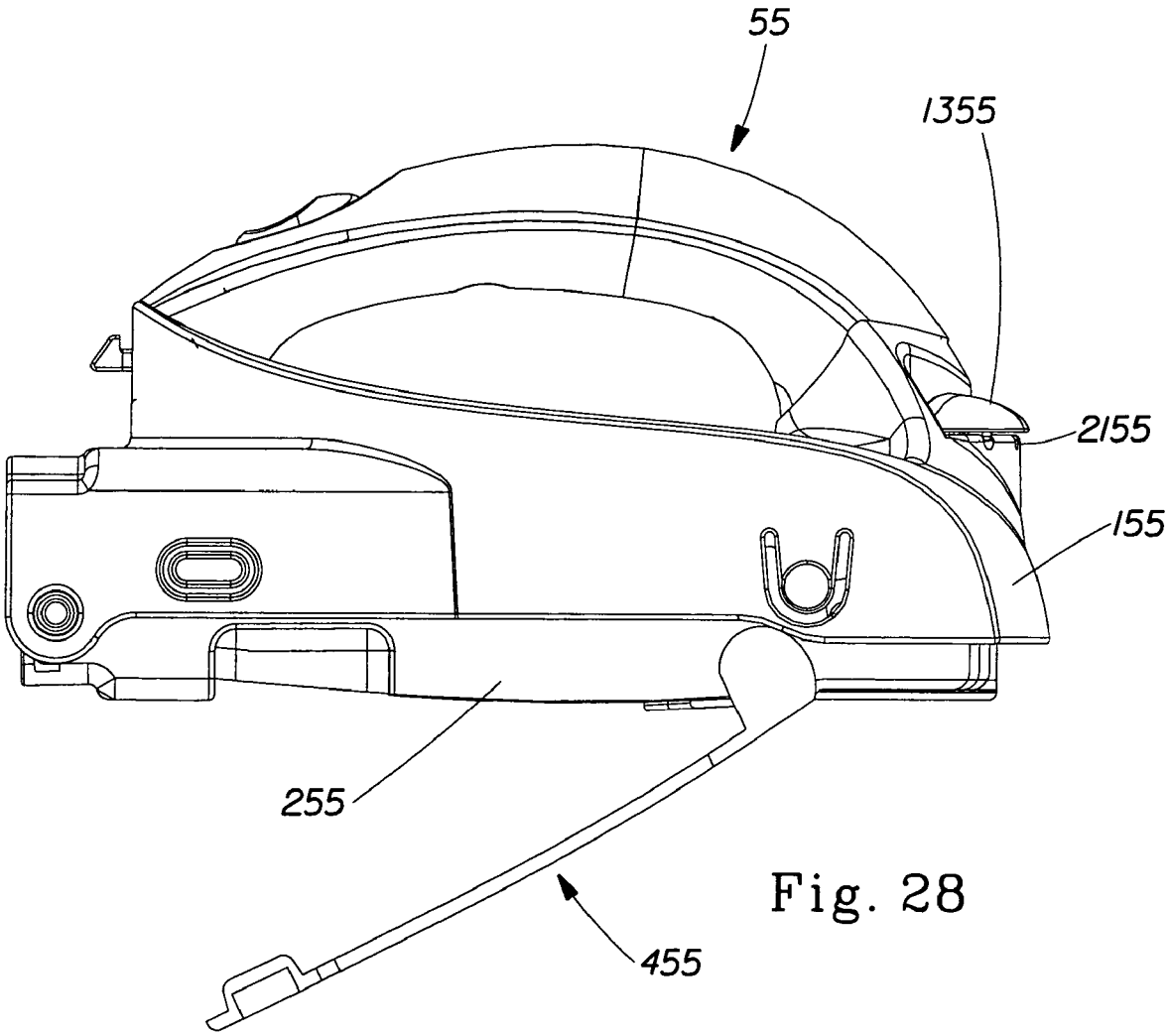
FIG. 28 is a side view of a collection bin of the invention.

In one embodiment represented in FIG. 28, the lower chassis member 255 includes a bottom wall 455 that is operably connected to the lower chassis member 255 such that the bottom wall is at least partially movable relative to the lower chassis member 255. In a preferred embodiment, the bottom wall 455 is pivotably connected to the back portion of the lower chassis member 255 (i.e. away from the opening 1055). Among other benefits, a pivotable bottom wall 455 allows a user to reach the interior of the collection bin 55 and it also allows a user to attach a disposable cleaning substrate to the collection bin 55. The bottom wall 455 can have any desired shape such as rectangular, triangular and/or rounded.

In one embodiment, the collection bin is permanently attached to the sweeper head 30 such that it forms an integral part of the sweeper head.

In a preferred embodiment, the collection bin is removably connected to the sweeper head 30 such that a user can empty the content of the bin into a trashcan and dispose of the cleaning substrate without having to carry the whole sweeper head 30.

Figure 29:
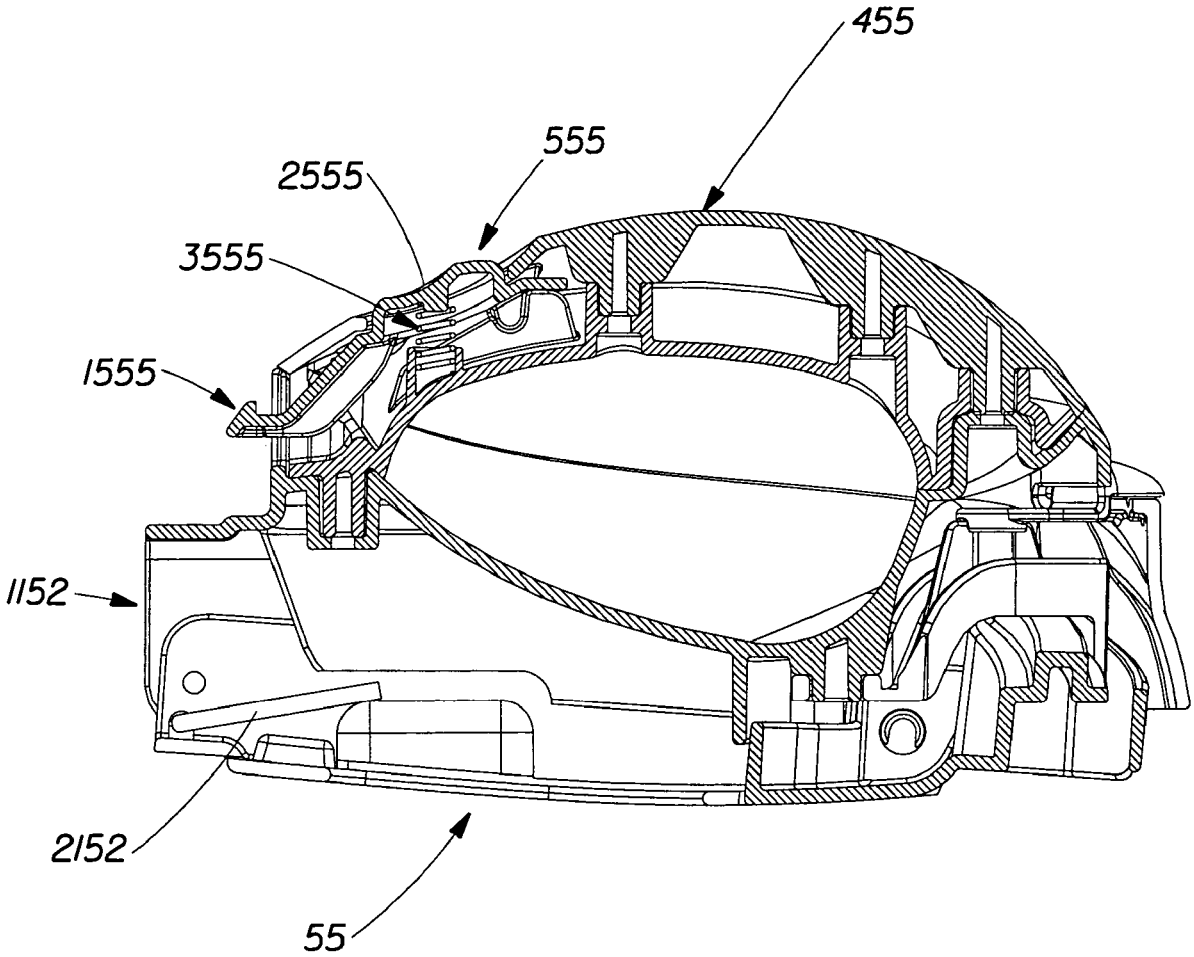
FIG. 29 is a cross-section view of the collection bin of FIG. 28 showing the locking mechanism of a collection bin.

In one embodiment shown in FIG. 29, a collection bin 55 includes a grip member 455 for allowing a user to remove and carry the collection bin 55.

FIG. 29 shows a partial cross sectional view of the collection bin 55 which includes a locking mechanism 555 for maintaining the collection bin connected to the sweeper head of the implement. In one embodiment, the locking mechanism 555 has a male portion 1555 capable of engaging a corresponding female portion of the sweeper head. In a preferred embodiment, a user can disengage the male and female portions, by pushing a release button 2555 extending from the grip member 455. In a preferred embodiment, the locking mechanism is spring-loaded via a coil-spring 3555.

In one embodiment, a collection bin 50, which is preferably removably connected to a sweeper head 30 and has a grip member 450, can be used with a cleaning substrate independently from the sweeper head 30. In this embodiment, the collection bin 50 can be viewed as a miniature cleaning implement which can be used in combination with a cleaning substrate to remove soils capable of entanglement from smaller soft surfaces such as carpeted staircases, cushions covered with a fabric and/or soft surfaces which are hard to reach with a cleaning implement such as furniture covered with fabric, upholstery or any type of vertical surface covered with a fabric such as walls or curtains.

Figure 30:
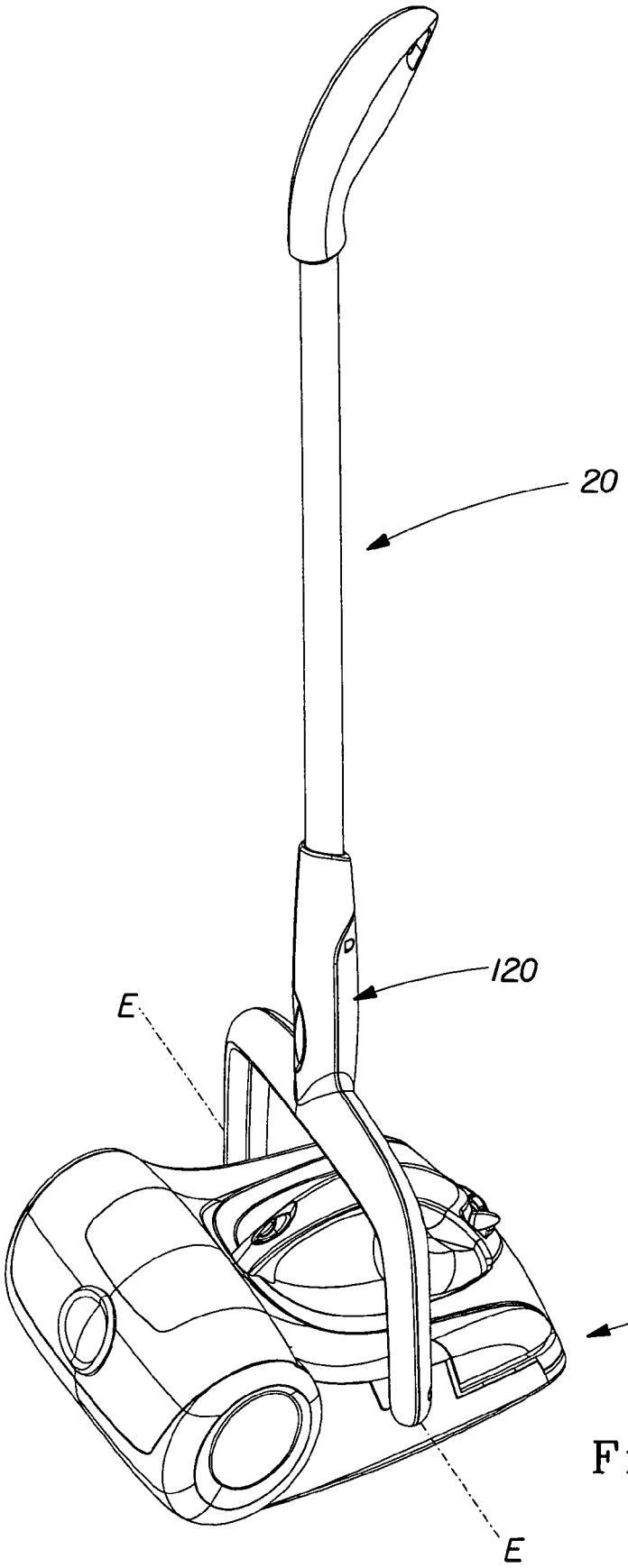
FIG. 30 is a perspective view of a cleaning implement of the invention.

In a preferred embodiment represented in FIG. 30, the handle 20 is connected to a yoke member 120 having a first and a second leg portion 1120 and 2120, which is operably connected to the sweeper head 30 along at least one rotational axis E-E. The handle 20 can be any handle known in the art and can be made of a single piece, segmented, telescopic or collapsible.

In one embodiment, the distance between the first and second leg portions 1120, 2120 is greater than the width of the sweeper head such that when the cleaning implement is lift from a floor surface, the front of the sweeper head 30 tilts towards the floor and the rear portion of the sweeper head is then located in between the first and second leg portions 1120, 2120 of the yoke member 120 as shown in FIG. 1. Among other benefits, the previous yoke member allows a user "to hang" the cleaning implement on a hook against a wall while minimizing the space taken by the sweeper head.

In one embodiment, a cleaning implement can have a vacuum generating element instead of or in addition to the rotating member previously described and still provide the same benefit. One skilled in the art will understand that a vacuum generating element is capable of removing loose soils from either a soft or a hard surface by creating a negative pressure that generates an airflow capable of carrying loose soils into a collection bin. In a preferred embodiment, a vacuum generating element includes a suction nozzle in fluid communication with a fan that is operably connected to a motor. The motor of the vacuum generating element can be powered either by at least one battery or by an electrical outlet electrically connected to the motor.

II. Disposable Cleaning Substrate

A variety of removable cleaning substrates can be attached to the cleaning implement in order to remove soils capable of entanglement, from soft surfaces. The cleaning substrate can include a woven or nonwoven fibrous material including synthetic, natural, or hybrid fibers. The substrate can also include a polymeric film. The substrate can be made from a variety of processes including, but not limited to, hydroentanged, spunbonded, meltblown, carded, and the like. In a preferred embodiment the substrate includes a nonwoven fibrous material including synthetic fibers and is formed via a hydroentangling or spunbonded process.

Figure 31:
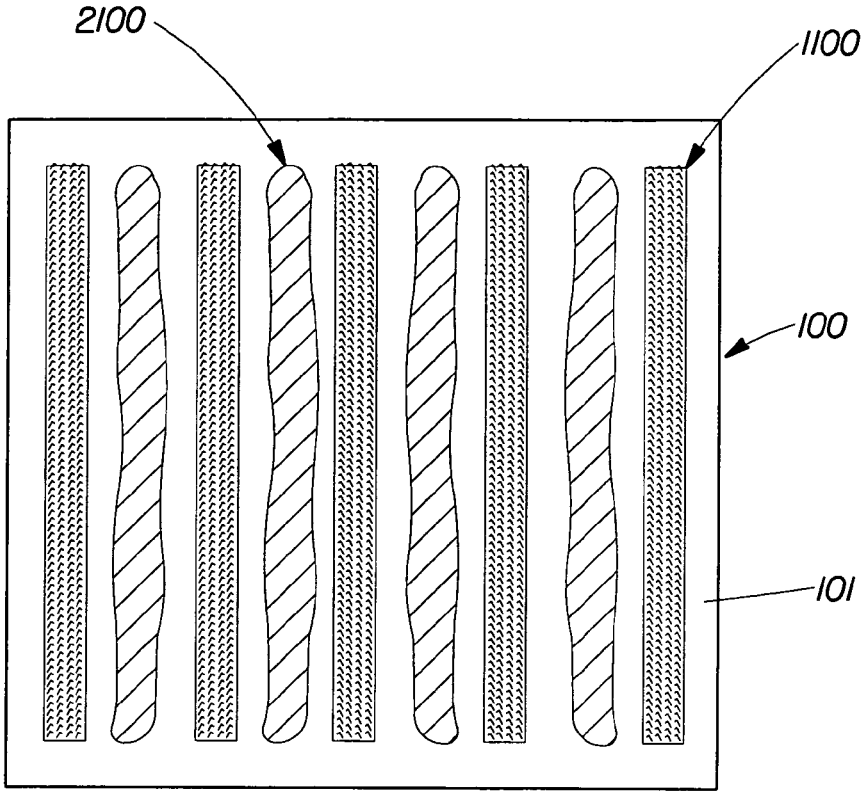
FIG. 31 is a bottom view of a disposable cleaning substrate of the invention.
Figure 32:
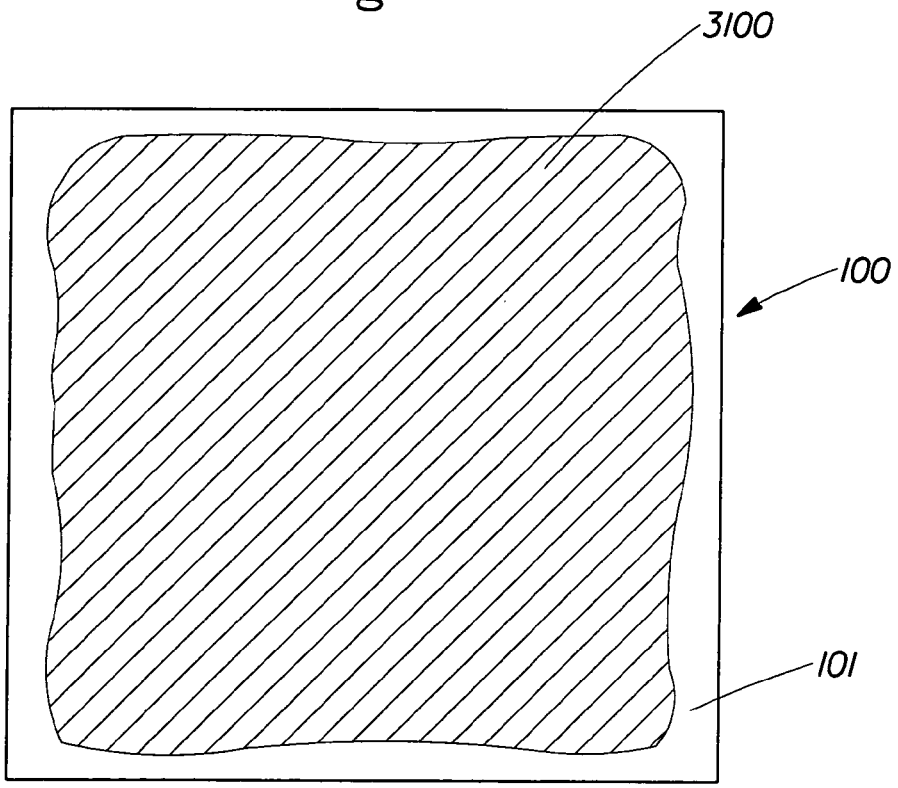
FIG. 32 is a top view of the cleaning substrate of FIG. 31.

FIGS. 31 and 32 show respectively the bottom and top surfaces of an example of suitable removable/disposable cleaning substrates for use with the cleaning implements of the present invention. It is to be understood that a "bottom surface" of a cleaning substrate is the surface which is with the closest to the surface to be cleaned during the cleaning operation. Conversely, the "top surface" is the surface of the cleaning substrate, which is away from the surface being cleaned during the cleaning operation.

In one embodiment, a disposable cleaning substrate is in the form of a disposable cleaning sheet 100 comprising a substrate 101 and a plurality of protrusions 1100 affixed to the substrate 101, preferably to the bottom surface of the substrate. In a preferred embodiment, the substrate 101 comprises at least one but preferably a plurality of rows of protrusions 1100. In an even more preferred embodiment, the cleaning sheet is attached to the cleaning implement such that the rows of protrusions 1100 are substantially perpendicular to the forward and backward motion of the sweeper head during the cleaning operation. The protrusions 1100 can be any protrusion known in the art. Non-limiting examples of suitable protrusions include hook-shaped protrusions, slanted fibers, bristles, and the like. Such cleaning sheets are particularly suitable for removing soils capable of entanglement, such as hair, from soft surfaces, such as upholstery, fabric, carpet, and the like. Preferred substrates and protrusions are described in detail in co-pending U.S. application Ser. No. 10/161,445, Publication No. 2003/0049407A1 published Mar. 13, 2003 to Kacher et al. (now abandoned), U.S. application Ser. No. 10/161,444, Publication No. 2003/0044569A1 published Mar. 6, 2003 to Kacher et al. (now abandoned), both assigned to The Procter & Gamble Company.

In one embodiment, the bottom surface of the substrate 101 includes an additive 2100 for retaining the soils capable of entanglement that have been removed from the soft surface by the protrusions 1100 during the cleaning operation. Non-limiting examples of suitable additives include polymeric additives, tacky polymers, pressure sensitive adhesives, oil gels, waxes, and any mixtures thereof. Non-limiting examples of suitable tacky polymers include polyisobutylene polymers, N-decylmethacrlate and mixtures thereof. Non-limiting examples of suitable of pressure sensitive adhesives are available from the H.B. FULLER Company of St. Paul, Minn. 55164 under the trade names HL-1496, HL-1500, HM-1597, HM-1902, HM-1972, HM-2713. Non-limiting examples of suitable oil gels or hot melt are available from the National Starch Company under the name SoftGel 546-47E. Non-limiting examples of suitable waxes include paraffin, beeswax, microcrystalline waxes, and mixtures thereof.

In one embodiment shown in FIG. 32, the top surface of the substrate 101 can include an additive 3100, preferably a tacky additive selected from the group consisting of tacky polymers, pressure sensitive adhesives, oil gels, waxes; and any mixtures thereof. Among other benefits, an additive having adhesive or tacky properties, which is applied to the top surface of the substrate, can be used to removably attach the cleaning sheet to the bottom surface of a sweeper head, preferably the bottom surface of a collection bin, of any of the cleaning implements previously described. During the cleaning operation, the top surface of the cleaning sheet is in contact with at least a portion of a sweeper bead and/or collection bin such that the protrusions 1100 can engage the soft surface to be cleaned.

In addition, an additive on top of the cleaning substrate can retain loose soils, which have been projected by a rotating member, especially when the bottom wall of the collection bin includes at least one opening. It will be appreciated that the top and bottom surface of such a cleaning sheet concurrently capture and/or retain soils during the cleaning operation. When the soft or hard surface is clean, a user can simply remove the cleaning sheet, which includes predominantly soils capable of entanglement on its bottom surface and loose soils on its top surface, which are at least partially retained by the additive 3100.

One skilled in the art will understand that in the event the additive 3100 has poor or no adhesive or tacky properties, the cleaning sheet 100 can be attached to the sweeper head and/or the collection bin via any means for retaining a cleaning substrate known in the art. Non limiting examples of suitable means for retaining a substrate include hook and loop fasteners, and/or mechanical structures located on the implement such as deformable slitted structures, clips and pinching mechanisms.

Figure 33:
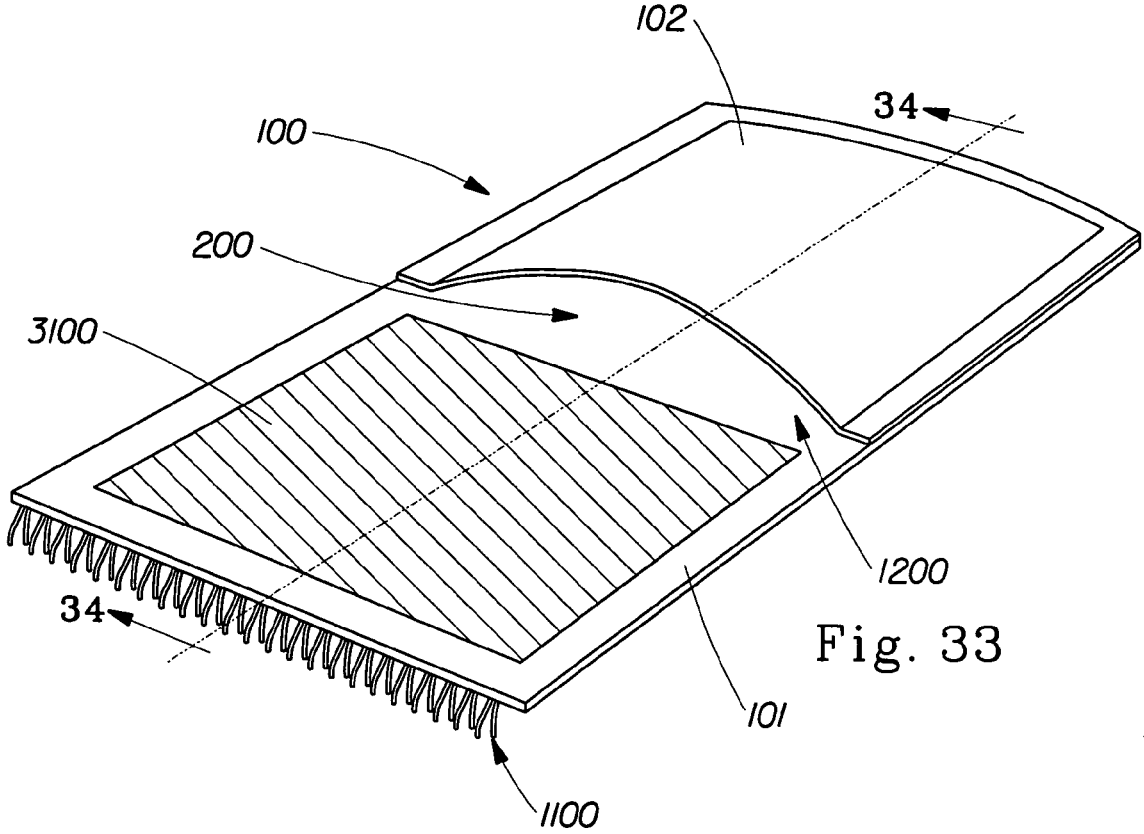
FIG. 33 is a perspective view of a disposable cleaning substrate of the invention.
Figure 34:
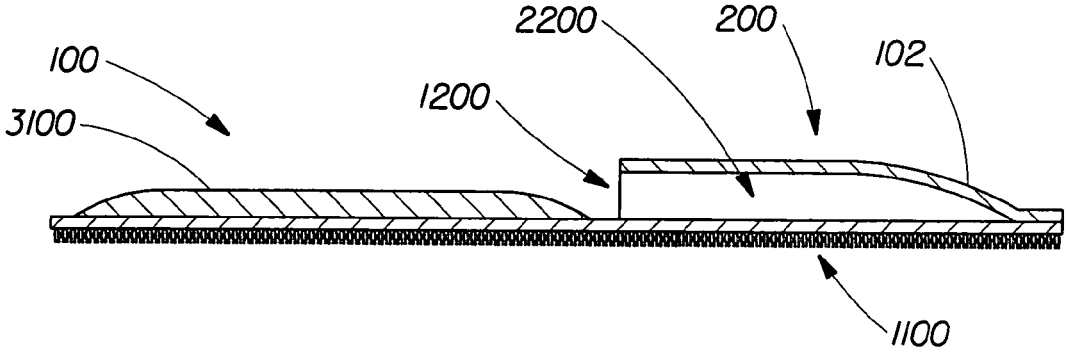
FIG. 34 is a cross-sectional view of the cleaning substrate of FIG. 33.

FIG. 33 shows the top surface of a disposable cleaning sheet 100 that includes at least one pocket or pouch 200 having an opening 1200 for accessing a cavity 2200. FIG. 34 shows a cross sectional view of the disposable cleaning sheet of FIG. 33 taken along the axis 33-33. The pocket or pouch 200 can be made by attaching a layer of a second substrate 102 to the top surface of the first substrate 101. The pocket or pouch can also be formed by folding at least a portion of a first substrate on itself and then by securing the folded portion to lower portion of the substrate to for a cavity accessible via an opening. The pocket 200 allows the cleaning sheet to be retained at the bottom surface of a collection bin, in particular when the collection bin includes a pivotable bottom wall as shown in FIG. 28. A user can attach the cleaning sheet 100 by inserting the front portion of the bottom wall within the pocket 200 through the opening 1200. Once the bottom wall is inserted, a user can push the bottom wall back to its original position. In one embodiment, the top surface of the first substrate 101 and/or the top surface of the second substrate 102 include an additive 3100 as previously described and which preferably has adhesive or tacky properties.

The pocket or pouch 200 can have any desired shape but the shape of the pocket 200 preferably corresponds to the shape of the bottom wall 350. For example, if the outer edges of the front portion of bottom wall form a rectangular shape, it is preferred that the pocket also has a rectangular shape.

Figure 35:
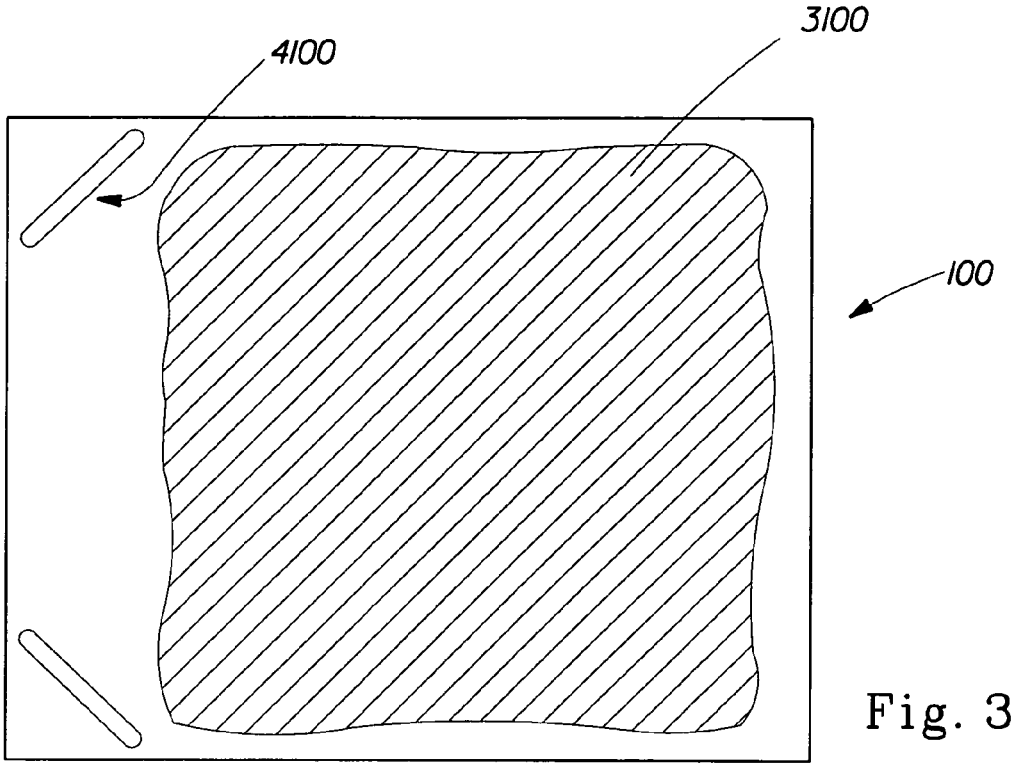
FIG. 35 is a top view of a disposable cleaning substrate of the invention.

In one embodiment shown in FIG. 35, a cleaning sheet can include at least one but preferably a plurality of slits 4100 for allowing at least a portion or portions of the bottom wall 350 of a collection bin to be inserted through the slit(s) 4100.

Figure 36:
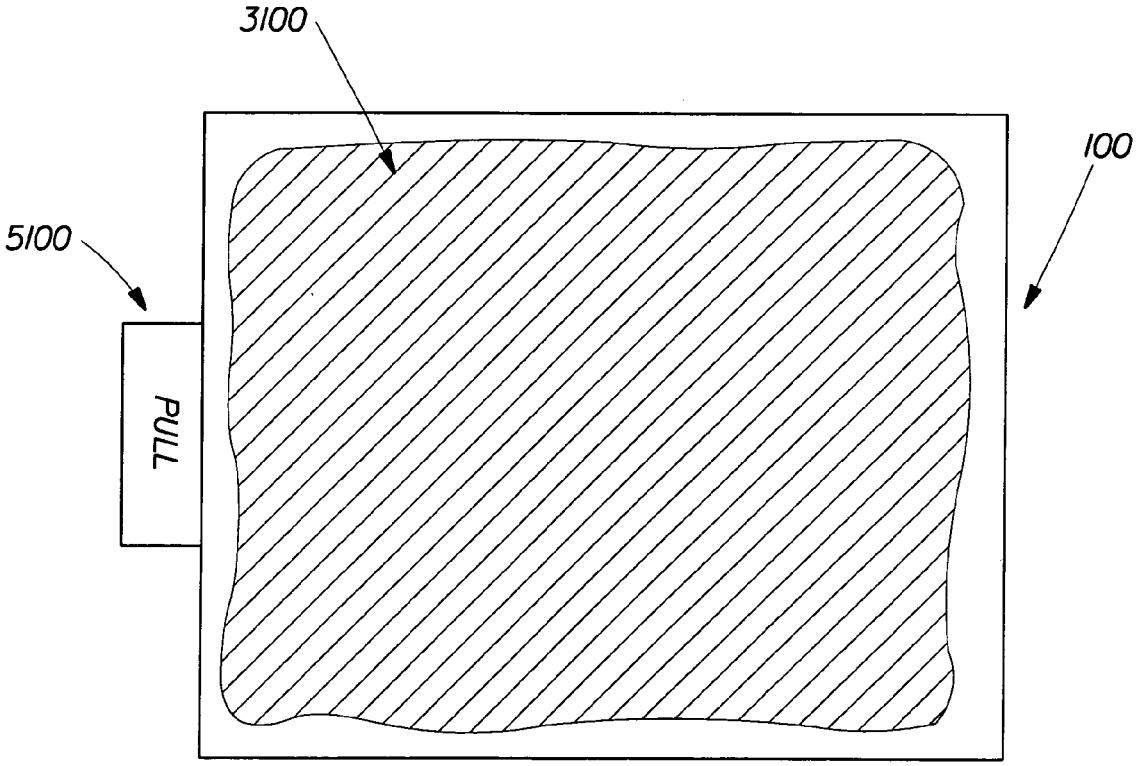
FIG. 36 is a bottom view of a disposable cleaning substrate.

In one embodiment schematically represented in FIG. 36, a cleaning substrate 100 includes at least one extension piece or tab 5100 on at least a portion of the cleaning substrate, preferably the front portion of the substrate. As previously discussed, the top and/or bottom surface of the substrate are collecting respectively loose soils and soils capable of entanglement during the cleaning operation. The extension piece or tab 5100 allows a user to remove or detach the cleaning substrate easily from the cleaning implement at the end of the cleaning operation without having to touch these soils. In a preferred embodiment, the extension piece or tab is preferably substantially free of any additive and/or protrusion such that the extension piece or tab does not collect soils during the cleaning operation. As a result, the extension piece or tab remains substantially clean and provide a clean surface which can be grasped and/or pulled by the user in an hygienic manner.

In a preferred embodiment the extension piece or tab 5100 is located adjacent to the front portion of the cleaning substrate such that it extends in front of the cleaning substrate. In a preferred embodiment, the extension piece or tab is located substantially at the middle or center of the front portion of the cleaning substrate.

One skilled in the art will understand that the extension piece or tab is preferably sized such that it is easily "graspable" by a user. In one embodiment, the extension piece or tab is sized such that it includes a "graspable clean surface" of at least about 0.25 $cm^2$, preferably at least about 1 $cm^2$, and more preferably at least about 2 $cm^2$. In one embodiment, the extension piece or tab is sized such that it includes a "graspable clean surface" of less than about 40 $cm^2$, preferably less than about 10 $cm^2$, and more preferably less than about 5 $cm^2$. By "graspable clean surface", it is meant the area of the extension piece or tab which is substantially free of any additive or protrusions capable or retaining soils.

In one embodiment, the length of the extension piece or tab is less than about 5 cm, preferably less than about 3 cm and more preferably less than about 2 cm such that it does not interfere or get in contact with the rotating member and or the bottom surface of the cleaning substrate during the cleaning operation.

The extension piece or tab can be made of woven or nonwoven fibrous material, films, cardstock and any combinations thereof. The extension piece or tab can be a separate piece of material that is affixed to the cleaning substrate or it can be formed concurrently with the cleaning substrate by removing or cutting a potion of the cleaning substrate.

In one embodiment, the extension tab can be an adhesive portion, preferably on the top of the extension tab, such that at least a portion of the top surface of the tab can be adhesively connected to the bottom surface of the implement during the cleaning operation.

It will be appreciated that any of the previously described cleaning substrate or cleaning sheet can include an extension piece or tab as previously discussed.

Among other benefits, an extension piece or tab also allows a consumer to operably pivot a pivotable bottom wall of a sweeper or collection bin as previously discussed and shown in FIG. 28. When the cleaning substrate having an extension piece or tab is attach to a sweeper and/or a collection bin, a user can pivot the pivotable wall, and as a result, "open" the bin, by pulling onto the extension piece or tab in a direction having a component that is substantially perpendicular to the pivot axis of the pivotable wall.

In order to convey the benefits of the extension piece or tab of a cleaning substrate to a user, instructions can be included in the form of an indicia chosen from at least one of an icon, a picture, a word, a symbol, and any combination thereof which can be added on the cleaning substrate, the extension piece or tab a package containing the cleaning substrate and/or in website accessible via the Internet and explaining how best to attach/detach sheet and/or bin from implement.

The cleaning sheets of the present invention are especially useful in removing soils capable of entanglement that are typically difficult to remove from soft surfaces, such as carpet or upholstery. Pet hair and human hair are particularly difficult to remove from soft surfaces such as carpeting. The cleaning sheets of the present invention, however, are particularly effective in removing such debris from soft surfaces and are conveniently disposable after use. Thus the cleaning sheet can be simply thrown away after use, along with all of the soils collected by the cleaning sheet.

In one embodiment, any of the foregoing cleaning substrate or cleaning sheet which comprise an additive and especially a tacky additive, can include a release paper or liner protecting said additive before use. One skilled in the art will understand that when a user wishes to use a cleaning substrate to clean a soft surface, he or she can simply remove the protective release paper or liner to uncover the additive. In one embodiment, the outer surface (i.e. exposed) of the release paper or liner can include instructions conveying to the user how to properly attach and/or use the cleaning sheet.

A. Substrates

A disposable cleaning sheet can be made from different types of substrates. The substrates can be woven or nonwoven and can be made of synthetic, natural, or hybrid fibers. The substrates can also be a polymeric film or by forming operations using melted materials laid down on forms, especially in belts, and/or by forming operations involving mechanical actions/modifications carried out on films. The structures are made by any number of methods (e.g., spunbonded, meltblown, resin bonded, air-through bonded, etc.). Preferred substrates include nonwoven substrates selected from the group consisting of spunbonded substrates, meltblown substrates, hydroentangled substrates, thermoplastic film substrates, airlaid substrates, carded substrates, and combinations thereof.

Materials particularly suitable for forming the preferred nonwoven substrates of the present cleaning sheets include, for example, natural cellulosics as well as synthetics such as polyolefins (e.g., polyethylene and polypropylene), polyesters, polyamides, synthetic cellulosics (e.g., RAYON®), and blends thereof. Also useful are natural fibers, such as cotton or blends thereof and those derived from various cellulosic sources. Preferred starting materials for making the substrates of the present cleaning sheets are synthetic materials, which may be in the form of carded, spunbonded, meltblown, airlaid, or other structures. Particularly preferred are polyesters, especially carded polyester fibers, polypropylene fibers, and polyethylene fibers. The resistance to abrasion and tearing of the substrate as the cleaning sheet is rubbed across the surface, e.g. carpet, upholstery, or other fabric surface, can be an important factor in selected the form of the substrate and the fiber composition. The degree of hydrophobicity or hydrophilicity of the fibers is further optimized depending upon the desired goal of the sheet, either in terms of type of soil to be removed, the type of additive that is provided, when an additive is present, biodegradability, availability, and combinations of such considerations. In general, the more biodegradable materials are hydrophilic, but the more effective materials tend to be hydrophobic.

The substrates can be formed from a single fibrous layer or can be a laminate of two or more separate layers. Preferably, the sheets are nonwovens made via a hydroentangling or spunbonded process. In this regard, prior to hydroentangling discrete layers of fibers, it may be desired to slightly entangle each of the layers prior to joining the layers by entanglement.

To enhance the integrity of the substrate, a polymeric net (referred to herein as a "scrim" material) can be incorporated in the substrate, such that the scrim material is arranged with the fibrous material, e.g., though lamination via heat or chemical means such as adhesives, or via hydrogentanglement. Scrim materials useful herein are described in detail in U.S. Pat. No. 4,636,419. The scrims may be formed directly at the extrusion die or can be derived from extruded films by fibrillation or by embossment, followed by stretching and splitting. The scrim may be derived from a polyolefin such as polyethylene or polypropylene, copolymers thereof, poly(butylene terephthalate), polyethylene terephthalate, Nylon 6, Nylon 66, and the like. Scrim materials are available from various commercial sources. A preferred scrim material useful in the present invention is a polypropylene scrim, available from Conwed Plastics (Minneapolis, Minn.).

The substrates of the present cleaning sheets will typically have a basis weight of from about 15 to about 1.95 g/m$^2$, preferably from about 20 to about 90 g/m$^2$, and more preferably from about 30 to about 80 g/m$^2$. The substrate can comprise one or more fiber layers. Each fiber layer can be of the same construction or can be of different construction.

Preferred substrates herein include a carded, thermal bonded fibrous web having a basis weight of 70 g/m$^2$ comprised of 80% of polypropylene fibers and 20% of rayon fibers. Another preferred substrate is a trilayer laminate comprising two outer spunbond layers and an inner meltblown layer with a basis weight of 48 g/m2, and comprises 100% polypropylene. Both preferred substrates are commercially available from BBA Nonwovens (Simpsonville, S.C. USA). Other suitable substrates are described in detail in U.S. patent application Ser. No. 09/082,349, U.S. Pat. No. 6,645,604 granted Nov. 11, 2003; U.S. Application Ser. No. 09/082,396, U.S. Pat. No. 6,561,354 granted May 13, 2003; and U.S. application Ser. No. 09/729,626, Publication No. 2001/0029966A1 published Oct. 18, 2001, now abandoned.

One skilled in the art will understand that in the event a disposable cleaning sheet is used with a cleaning implement comprising slitted structures, such as the structures described in copending U.S. patent application Ser. No. 10/216,117, U.S. Pat. No. 6,651,290 to Kingry et al., granted Nov. 25, 2003, and assigned to The Procter & Gamble Company, the substrate will be sized such that at least a portion of the substrate is removably "grippable" by the slitted structures.

B. Protrusions

The cleaning sheets of the present invention further comprise a plurality of protrusions affixed to the substrate described herein. The protrusions of the present cleaning sheets enhance the pick-up of soils capable of entanglement, especially animal hair or human hair, from surfaces, especially soft surfaces such as carpeting, upholstery, and the like. In addition, when a cleaning sheet with protrusions is used to clean a carpet, some of protrusions, which reach within the carpet fibers are capable of bringing to the surface of the carpet, small particulates which can then be removed by the rotating member of the implement previously described. In a preferred embodiment, the protrusions are chosen such that they do not snag into the carpet.

The protrusions can be of a variety of shapes including, but not limited to, hooks, slanted fibers, bristles, and the like. The plurality of protrusions affixed to the substrate can be all of a uniform shape or can be a combination of different shapes. Preferably at least some of the protrusions are hook-shaped protrusions. Preferred hook-shaped protrusions include a variety of types, including, for example, "J-type" hooks, "Prong-type" hooks, "Mushroom-type" hooks, "Banana-type" hooks, "Y-type" hooks, "Multi-tipped" hooks and the like.

The protrusions provided with a cleaning sheet can be made of a variety of materials. For example, the protrusions can be formed from materials including, but not limited to, polymers, polymeric resins, and the like, preferably thermoplastic resins. The thermoplastic resins preferably comprise a thermoplastic polymer and can preferably further comprise tackifying resins, plasticizers, and other optional ingredients such as diluents, stabilizers, antioxidants, colorants, and fillers. Suitable tackifying resins and plasticizers are described in co-pending U.S. application Ser. No. 09/821,953, Publication No. 2002/0042962A1 on published Apr. 18, 2002 by Kacher et al. (now abandoned).

A preferred material from which to form protrusions of the present cleaning sheets are thermoplastic resins. The thermoplastic resins herein will typically have a softening temperature of from about 45° C. to about 260° C., more preferably from about 80° C. to about 200° C., and even more preferably from about 90° C. to about 180° C. "Softening temperature" of a thermoplastic resin can be measured according to a standard method, ASTM D1525.

Preferred thermoplastic resins comprise thermoplastic polymer selected from the group consisting of: styrene copolymer blends, wherein the copolymer is selected from the group consisting of butadiene, acrylonitrile, divinylbenzene, maleic anhydride; block copolymers containing polystyrene endblocks and polyisoprene, polybutadiene, and/or polyethylene-butylene midblocks; polyolefins such as polyethylene, polypropylene, amorphous polypropylene, polyisoprene, and polyethylene propylene; ethylene-vinylacetate copolymers; acrylonitrile-butadiene copolymers; polyesters such as polyethylene terphthalate; polyamides such as Nylon 6 and Nylon 11; polyisobutylene; poly(vinyl ethylene-co-1, 4-butadiene); natural rubber [poly cis-isoprene]; polyacrylic acid and salts thereof; polymethacrylic acid and salts thereof; polydimethylsiloxane; polydiphenylsiloxane; poly methyl phenyl siloxane; polyvinyl alcohol; polyvinyl chloride; polyvinylidene chloride; polyurethane; and mixtures thereof.

Preferably, the thermoplastic resins used to form protrusions have a certain degree of elasticity. The degree of elasticity is related to Young's modulus, which is the ratio of the tensile stress to the extension strain of a given material. The value of Young's modulus indicates the resistance of a material to reversible longitudinal deformation. Simplistically, it can be considered as the theoretical stress or force required to double the length of a specimen. *The Handbook of Common Polymers—Fibres, Films, Plastics, and Rubber*, complied by W. J. Roff et al. (1971), lists the Young's modulus for a number of materials. Young's modulus can be measured using a standard method known as ASTM D797. Typical values for Young's modulus for thermoplastic resins/polymers at 20° C. to 25° C. of the present invention, when said resin/polymer is in the form of filaments, threads, or wires, and where the relative humidity is 65% when the humidity can impact the results, are shown in the following table:

Young's Modulus of Common Thermoplastic Resin/Polymer Fibers

| Resin/Polymer | $kN/m^2$ ($\times 10^{-4}$) |
|---|---|
| Rubber (Vulcanized, soft; thread) | 0.15 |
| Polyurethane (elasteromeric thread) | 1.0 |
| Polyethylene (low density) | 79 |
| Polyvinylidene Chloride | 100-150 |
| Nylon 6 | 200-290 |
| Cellulose Acetate | 290-440 |
| Polyvinyl Alcohol | 200-1180 |
| Polypropylene (monofilament) | 320 |
| Polyacrylnitrile | 390-690 |
| Polyester (Terylene) | 390-1470 |
| Polyethylene (high density) | 390 |
| Polyvinyl chloride | 490 |
| Nylon 11 | 490 |
| Viscose Rayon | 590-880 |
| Polypropylene (continuous filament yarn) | 640 |

The preferred protrusions of the present cleaning sheets are formed of a material having a Young's modulus of from about 1 to about 1500 $kN/m^2$ ($\times 10^{-4}$), preferably from about 50 to about 1000 $kN/m^2$ ($\times 10^{-4}$), and more preferably from about 75 to about 750 $kN/m^2$ ($\times 10^{-4}$).

Thermoplastic resins preferred herein for forming protrusions of the present cleaning sheets include polyethylene (which can be low density, high density and/or cross linked), polypropylene (monofilament or continuous filament), and mixtures thereof.

In general, strips of thermoplastic material carrying a plurality of protrusions can be affixed to the substrate such that the strips of protrusions cover from about 5% to about 100%, preferably from about 10% to about 70%, and more preferably from about 15% to about 60% of the surface area of at least one outer surface of the substrate. The protrusions can be affixed to only one outer surface of the substrate of the cleaning sheet but the protrusions can also be affixed to both outer surfaces.

The protrusions or strips of protrusions can be affixed to the substrate herein in order to create rows of protrusions. The protrusions will generally be positioned such that the distance between two consecutive protrusions in a given row will be at least 0.15 mm, from about 0.2 to about 10 mm, preferably from about 0.2 to about 5 mm, preferably from about 0.3 to about 5 mm, more preferably from about 0.6 to about 3 mm, even more preferably from about 0.8 to about 3 mm, and most preferably from about 0.9 to about 2 mm. The number of protrusions per square centimeter will typically be from about 1 to about 1000, preferably from about 10 to about 100, and more preferably from about 20 to about 50. In one embodiment, two or more protrusions can share a common base and then flare outwards to become separated.

As discussed hereinbefore, the protrusions of the present cleaning sheets can be a variety of shapes. For example, the protrusions can be slanted fibers. The slanted fibers preferably have a sufficient Young's modulus to provide enough resiliency (e.g. low elasticity) to the slanted fibers to enable the slanted fibers to dislodge debris from the surface being cleaned. Slanted fibers are straight protrusions that extend from the substrate at an acute angle, with respect to the substrate.

The protrusions can also include bristles, which are similar to slanted fibers, except that they extend perpendicularly straight out from the substrate, forming a 90° angle with the substrate.

Preferred protrusions herein, however, are hook-shaped protrusions. Hook-shaped protrusions can themselves come in a variety of shapes. Preferred hook-shaped protrusions include, for example, "J-type" hooks, "Prong-type" hooks, "Mushroom-type" hooks, "Banana-type" hooks, "Y-type" hooks, "Multi-tipped" hooks and the like, as described hereinafter.

The present cleaning sheets comprise a plurality of protrusions, which can all be of the same shape or can be a combination of protrusions having two or more different shapes. It is also possible to have a plurality of protrusions which are all facing towards the same direction or which are pointing towards different directions. The shapes and resiliency of the protrusions are preferably selected based on the surface desired to be cleaned, especially soft surfaces such as carpet, upholstery, and the like. In order to yield the best of debris removal and easy movement of the cleaning sheet across the surface, the shape and resiliency of the protrusions can also be selected based on the type of carpet or upholstery being cleaned. For example, more aggressive hooks (e.g. less elasticity and/or more curl in the engagement end of the hook) can be used on plush carpet, while less aggressive hooks (e.g. more elasticity and/or less curl in the engagement end of the hook) are preferred for loop-type carpet, such as berber carpet. Typically, the thinner the protrusions and the greater the distance between individual protrusions, the less aggressive the resulting cleaning sheet will be.

In one embodiment, a cleaning sheet including protrusions can be used with a "traditional" vacuum cleaner or a modified vacuum cleaner.

By "traditional vacuum cleaner", it is meant any existing vacuum cleaner, which does not necessarily include means for attaching a cleaning sheet. The cleaning sheet can include an adhesive coating, strings, straps, hook and loop fasteners for removably attaching the sheet to the bottom surface of a traditional vacuum cleaner. In the event a traditional vacuum cleaner does not include enough contacting surface for a cleaning sheet to be attached, a cleaning sheet can be operably connected to the vacuum cleaner via an adapter head that can be attached to the vacuum cleaner.

Traditional vacuum cleaners typically include a suction nozzle or head that is fluidically connected to a tube (e.g. canister vacuum cleaners). An adapter head can be either connected to or replace the suction nozzle or the suction head of such a vacuum cleaner.

By "modified vacuum cleaner" it is meant any vacuum cleaner, which includes means for retaining a cleaning sheet such that the cleaning sheet contacts the surface being cleaned during the vacuuming operation of the floor surface. In one embodiment, the means for retaining a cleaning sheet is a plate for receiving a cleaning sheet and which is operably connected to a portion of the vacuum cleaner such that the bottom portion of the sheet is in contact with the soft surface during the cleaning operation.

III. Cleaning Kits

In one embodiment, any of the previously discussed cleaning implements can be sold as a cleaning kit in combination with at least one but preferably a plurality of disposable cleaning substrates.

In one embodiment, the cleaning kit includes a cleaning implement, a disposable cleaning sheet having protrusions and a nonwoven cleaning sheet which does not include any protrusions. Among other benefits, this kit can be used to clean both soft surfaces and hard surfaces. A user can utilize the cleaning sheet having protrusions to clean a soft surface but he or she can also use the nonwoven cleaning sheet which does not include protrusions to clean hard surfaces. In one embodiment, the nonwoven cleaning sheet which does not include protrusions can be attached to the sweeper head directly via any of the methods previously discussed. In another embodiment, a user can attach a first cleaning sheet having protrusions to the sweeper head and then contact a second cleaning sheet, which does not include protrusions, against the bottom surface of the first cleaning sheet (i.e. the surface including protrusions). One skilled in the art will understand that the protrusions of the first cleaning sheet are capable of retaining the second cleaning sheet made of a nonwoven material during the cleaning operation. Among other benefits, the cleaning kit allows a user to clean both soft and hard surfaces with a single cleaning implement.

In one embodiment, a cleaning kit comprises a package including instructions printed on the package, a cleaning implement and/or at least one cleaning sheet.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that the scope of the invention is defined by the appended claims which should be construed as broadly as the prior art will permit.

What is claimed is:

1. A cleaning implement for cleaning a soft and/or a hard surface, said cleaning implement comprising:

a sweeper head having a collection bin having a first opening wherein said collection bin is removably connected to said sweeper head, the height of at least a portion of said collection bin being adjustable relative to the surface to be cleaned, said sweeper head comprising a rotating member for projecting loose soils from the surface being cleaned into said collection bin through said first opening; and a disposable cleaning substrate removably attachable to said collection bin.

2. The cleaning implement of claim 1 wherein said disposable cleaning substrate comprises a plurality of protrusions for removing soils capable of entanglement from said surface to be cleaned.

3. The cleaning implement of claim 2 wherein said height adjustable portion of said collection bin is movable from a first position to a second position.

4. The cleaning implement of claim 3 wherein said disposable cleaning substrate moves towards the surface to be cleaned when said height adjustable portion of said collection bin is moved from said first to said second position.

5. The cleaning implement of claim 1 wherein said sweeper head is capable of a rocking motion and said sweeper head rocks backward when said sweeper head is pushed forward by a user and said sweeper head rocks forward when said sweeper head is pulled backward by a user.

6. A cleaning implement for cleaning a soft and/or a hard surface, said cleaning implement comprising:

a sweeper head having a removable collection bin including a front opening, at least one side wall and a bottom wall operably and movably connected to said side wall such that said bottom wall is operably movable from a first position to a second position, wherein the height of at least a portion of said collection bin is adjustable from at least a first position to a second position relative to the surface to be cleaned, a cleaning substrate being removably connectable to said bottom wall of said collection bin.

7. The cleaning implement of claim 6 wherein said sweeper head comprises a rotating member for projecting loose soils from a surface being cleaned into said collection bin through said front opening.

8. The cleaning implement of claim 6 wherein said collection bin comprises at least a first indicia for conveying to a user that said height adjustable portion of said collection bin is in said first position wherein said first indicia is chosen from at least one of an icon, a picture, a word, a symbol, and any combinations thereof.

9. The cleaning implement of claim 8 wherein said collection bin comprises a second indicia for conveying to a user said height adjustable portion of said collection bin is in said second position wherein said second indicia is chosen from at least one of an icon, a picture, a word, a symbol, and any combinations thereof.

10. The cleaning implement of claim 9 wherein said first indicia represents a first carpet surface having a thickness and said second indicia represents a second carpet surface having a thickness and wherein the thickness of said first carpet is different from the thickness of said second carpet.

* * * * *

UNITED STATES PATENT AND TRADEMARK OFFICE

CERTIFICATE OF CORRECTION

PATENT NO. : 7,676,877 B2
APPLICATION NO. : 11/055891
DATED : March 16, 2010
INVENTOR(S) : Policicchio et al.

It is certified that error appears in the above-identified patent and that said Letters Patent is hereby corrected as shown below:

Column 4
Line 45, after the words side view of, delete "t".

Column 5
Line 15, delete "claim 20" and insert --FIG. 20;--.

Column 15
Line 12, delete "on" and insert --one--.
Line 53, delete "corrected" and insert --connected--.

Column 22
Line 29, delete "bead" and insert --head--.

Column 25
Line 36, delete "1.95" and insert --195--.

Signed and Sealed this
Eighth Day of March, 2011

David J. Kappos

David J. Kappos
*Director of the United States Patent and Trademark Office*